US010988695B2

(12) United States Patent
Van der Merwe et al.

(10) Patent No.: US 10,988,695 B2
(45) **Date of Patent: *Apr. 27, 2021**

(54) PROCESS AND SYSTEM FOR SOLVENT ADDITION TO BITUMEN FROTH

(71) Applicant: Fort Hills Energy L.P., Calgary (CA)

(72) Inventors: Shawn Van der Merwe, Calgary (CA); John Khai Quang Diep, Edmonton (CA); Mohammad Reza Shariati, Coquitlam (CA); Tom Hann, Onoway (CA)

(73) Assignee: FORT HILLS ENERGY L.P., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/039,953

(22) Filed: Jul. 19, 2018

(65) Prior Publication Data

US 2018/0320084 A1 Nov. 8, 2018

Related U.S. Application Data

(63) Continuation of application No. 14/002,836, filed as application No. PCT/CA2012/050107 on Feb. 23, 2012, now Pat. No. 10,041,005.

(30) Foreign Application Priority Data

Mar. 4, 2011 (CA) ..... CA 2733862

(51) Int. Cl.
*C10G 1/04* (2006.01)

(52) U.S. Cl.
CPC ..... *C10G 1/04* (2013.01); *C10G 1/045* (2013.01); *C10G 2300/4081* (2013.01); *C10G 2300/44* (2013.01)

(58) Field of Classification Search
CPC ..... C10G 1/04; C10G 1/045; C10G 1/047; C10G 2300/4081; C10G 2300/44
See application file for complete search history.

(56) References Cited

U.S. PATENT DOCUMENTS 1,085,135 A 1/1914 Kelly et al.
1,147,356 A 7/1915 Allen et al.
(Continued)

FOREIGN PATENT DOCUMENTS

CA 1027501 A 3/1978
CA 1055868 A 6/1979
(Continued)

OTHER PUBLICATIONS

Hobbs, Optimization of a static mixer using dynamical systems techniques, published 1998, Elsevier Science, Chemical Engineering Science, vol. 53, No. 18, pp. 3199-3213 [Cited in related U.S. Appl. No. 14/002,836].

(Continued)

*Primary Examiner* — Michelle Stein
(74) *Attorney, Agent, or Firm* — BakerHostetler

(57) ABSTRACT

The field of the invention is oil sands processing. A solvent treatment system and process for treating a bitumen-containing stream include contacting that stream with a solvent-containing stream to produce an in-line flow of solvent diluted material; supplying the solvent diluted material into a separation vessel with axi-symmetric phase and velocity distribution and/or particular mixing and conditioning features. The solvent addition, mixing and conditioning may be performed with particular CoV, Camp number, co-annular pipeline reactor, pipe wall contact of low viscosity fluid, flow diffusing and/or flow straightening. The processes (Continued)

enable improved performance of downstream unit operations such as separation of high diluted bitumen from solvent diluted tailings.

26 Claims, 8 Drawing Sheets

(56) References Cited

U.S. PATENT DOCUMENTS 1,159,044 A 11/1915 Kelly et al.
1,201,558 A 10/1916 Cobb et al.
1,254,562 A 1/1918 Allen et al.
1,261,671 A 4/1918 Zachert et al.
1,494,375 A 5/1924 Reilly et al.
1,754,119 A 4/1930 Frank et al.
1,777,535 A 10/1930 Walcott et al.
2,010,008 A 8/1935 Bray et al.
2,047,989 A 7/1936 William et al.
2,091,078 A 8/1937 Mckittrick et al.
2,111,717 A 3/1938 Rex et al.
2,188,013 A 1/1940 Stanislaw et al.
2,240,008 A 4/1941 Atwell et al.
2,410,483 A 11/1946 Dons et al.
2,853,426 A 9/1958 Peet et al.
2,868,714 A 1/1959 Gilmore et al.
3,081,823 A 3/1963 Constantikes et al.
3,220,193 A 11/1965 Strohmeyer et al.
3,271,293 A 9/1966 Lincoln et al.
3,278,415 A 10/1966 Doberenz et al.
3,291,569 A 12/1966 Joseph et al.
3,490,589 A * 1/1970 Cymbalisty ..... B01D 21/0018 209/163
3,575,842 A 4/1971 Simpson et al.
3,705,491 A 12/1972 Foster-pegg et al.
3,779,902 A 12/1973 Mitchell et al.
3,808,120 A 4/1974 Smith et al.
3,901,791 A 8/1975 Baillie
3,929,625 A 12/1975 Lucas
3,941,679 A * 3/1976 Smith ..... B01D 11/0219 208/390
3,954,414 A 5/1976 Samson, Jr. et al.
3,957,655 A 5/1976 Barefoot
3,963,599 A * 6/1976 Davitt ..... C10C 3/007 208/391
4,013,542 A 3/1977 Gudelis et al.
4,035,282 A 7/1977 Stuchberry et al.
4,115,241 A 9/1978 Harrison et al.
4,116,809 A 9/1978 Kizior
4,120,775 A 10/1978 Murray et al.
4,140,620 A 2/1979 Paulett
4,209,422 A 6/1980 Zimmerman et al.
4,210,820 A 7/1980 Wittig
4,230,467 A 10/1980 Buchwald et al.
4,251,627 A 2/1981 Calamur
4,284,242 A 8/1981 Randell
4,314,974 A 2/1982 Libby et al.
4,315,815 A 2/1982 Gearhart
4,321,147 A 3/1982 McCoy et al.
4,324,652 A 4/1982 Hack
4,342,657 A 8/1982 Blair, Jr.
4,346,560 A 8/1982 Rapier
4,395,330 A 7/1983 Auboir et al.
4,410,417 A 10/1983 Miller et al.
4,425,227 A 1/1984 Smith
4,461,696 A 7/1984 Bock et al.
4,470,899 A 9/1984 Miller et al.
4,495,057 A 1/1985 Amirijafari et al.
4,514,305 A 4/1985 Filby
4,518,479 A 5/1985 Schweigharett et al.
4,532,024 A 7/1985 Haschke et al.
4,539,093 A 9/1985 Friedman et al.
4,545,892 A 10/1985 Cymbalisty et al.
4,572,781 A 2/1986 Krasuk et al.
4,584,087 A 4/1986 Peck
4,609,455 A 9/1986 Weimer et al.
4,634,520 A 1/1987 Angelov et al.
4,640,767 A 2/1987 Zajic et al.
4,644,974 A 2/1987 Zingg
4,648,964 A 3/1987 Leto et al.
4,678,558 A 7/1987 Belluteau et al.
4,722,782 A 2/1988 Graham et al.
4,726,759 A 2/1988 Wegener
4,737,267 A * 4/1988 Pao ..... C10G 1/002 208/424
4,781,819 A 11/1988 Chirinos et al.
4,802,975 A 2/1989 Mehlberg
4,822,481 A 4/1989 Taylor
4,828,688 A 5/1989 Corti et al.
4,859,317 A 8/1989 Shelfantook et al.
4,888,108 A 12/1989 Farnand
4,906,355 A 3/1990 Lechnick et al.
4,929,341 A 5/1990 Thirumalachar et al.
4,931,072 A 6/1990 Striedieck
4,950,363 A 8/1990 Silvey
4,966,685 A 10/1990 Hall et al.
4,968,413 A 11/1990 Datta et al.
5,022,983 A 6/1991 Myers et al.
5,039,227 A 8/1991 Leung et al.
5,133,837 A 7/1992 Elmore et al.
5,143,598 A 9/1992 Graham et al.
5,186,820 A 2/1993 Schultz et al.
5,223,148 A 6/1993 Tipman et al.
5,236,577 A 8/1993 Tipman et al.
5,264,118 A 11/1993 Cymerman et al.
5,282,984 A 2/1994 Ashrawi
5,298,167 A 3/1994 Arnold
5,443,046 A 8/1995 White
5,558,768 A 9/1996 Ikura et al.
5,645,714 A 7/1997 Strand et al.
5,690,811 A 11/1997 Davis et al.
5,817,398 A 10/1998 Hollander
5,871,634 A 2/1999 Wiehe et al.
5,876,592 A 3/1999 Tipman et al.
5,879,540 A 3/1999 Zinke et al.
5,914,010 A 6/1999 Hood et al.
5,937,817 A 8/1999 Schanz et al.
5,948,241 A 9/1999 Owen
5,954,277 A 9/1999 Maciejewski et al.
5,968,349 A 10/1999 Duyvesteyn et al.
5,985,138 A 11/1999 Humphreys
5,988,198 A 11/1999 Neiman et al.
5,997,723 A 12/1999 Wiehe et al.
6,004,455 A 12/1999 Rendall
6,007,708 A * 12/1999 Allcock ..... B03D 1/02 208/390
6,007,709 A 12/1999 Duyvesteyn et al.
6,019,888 A 2/2000 Mishra et al.
6,036,748 A 3/2000 Wallace et al.
6,076,753 A 6/2000 Maciejewski et al.
6,110,359 A 8/2000 Davis et al.
6,120,678 A 9/2000 Stephenson et al.
6,159,442 A 12/2000 Thumm et al.
6,214,213 B1 4/2001 Tipman et al.
6,355,159 B1 3/2002 Myers et al.
6,358,403 B1 3/2002 Brown et al.
6,361,025 B1 3/2002 Cincotta et al.
6,391,190 B1 5/2002 Spence et al.
6,482,250 B1 11/2002 Williams et al.
6,497,813 B2 12/2002 Ackerson et al.
6,523,573 B2 2/2003 Robison et al.
6,566,410 B1 5/2003 Zaki et al.
6,746,599 B2 6/2004 Cymerman et al.
6,800,116 B2 10/2004 Stevens et al.
7,152,851 B2 12/2006 Cincotta
7,357,857 B2 4/2008 Hart et al.
7,569,137 B2 8/2009 Hyndman et al.
7,690,445 B2 4/2010 Perez-Cordova
7,749,378 B2 7/2010 Iqbal et al.
7,820,031 B2 10/2010 DAlessandro et al.
7,909,989 B2 3/2011 Duyvesteyn et al.
7,934,549 B2 5/2011 Cimolai
8,133,316 B2 3/2012 Poncelet et al.
8,141,636 B2 3/2012 Speirs et al.

(56) References Cited

U.S. PATENT DOCUMENTS 8,147,682 B2 4/2012 Lahaie et al.
8,157,003 B2 4/2012 Hackett et al.
8,252,107 B2 8/2012 Esmaeili et al.
8,261,831 B2 9/2012 Lockhart et al.
8,262,865 B2 9/2012 Sharma et al.
8,312,928 B2 11/2012 Lockhart et al.
8,343,337 B2 1/2013 Moffett et al.
8,354,020 B2 1/2013 Sharma et al.
8,357,291 B2 1/2013 Sury et al.
8,382,976 B2 2/2013 Moran et al.
8,394,180 B2 3/2013 Diaz et al.
8,449,764 B2 5/2013 Chakrabarty et al.
8,454,821 B2 6/2013 Chakrabarty et al.
8,455,405 B2 6/2013 Chakrabarty
8,550,258 B2 10/2013 Bara et al.
8,585,892 B2 11/2013 Robertson et al.
2002/0043579 A1 4/2002 Scheybeler
2003/0089636 A1 5/2003 Marchionna et al.
2004/0074845 A1 4/2004 Hagino et al.
2004/0256325 A1 12/2004 Frankiewicz et al.
2005/0150816 A1 7/2005 Gaston et al.
2005/0150844 A1 7/2005 Hyndman et al.
2006/0065869 A1 3/2006 Chipman et al.
2006/0138055 A1 6/2006 Garner et al.
2006/0196812 A1 9/2006 Beetge et al.
2007/0125719 A1 6/2007 Yarbrough et al.
2007/0180741 A1 8/2007 Bjornson et al.
2007/0284283 A1 12/2007 Duyvesteyn et al.
2008/0000810 A1 1/2008 Garner et al.
2008/0110281 A1* 5/2008 Sanders ..... G01F 1/44 73/861.63
2008/0185350 A1 8/2008 Remesat et al.
2008/0210602 A1 9/2008 Duyvesteyn
2009/0134059 A1 5/2009 Myers et al.
2009/0200210 A1 8/2009 Hommema
2009/0200688 A1 8/2009 Cincotta
2009/0294328 A1 12/2009 Iqbal
2009/0321322 A1* 12/2009 Sharma ..... C10G 1/045 208/390
2009/0321324 A1 12/2009 Sharma et al.
2010/0006474 A1 1/2010 Gaston et al.
2010/0076236 A1 3/2010 Van Heuzen et al.
2010/0078306 A1 4/2010 Alhazmy
2010/0089800 A1 4/2010 MacDonald et al.
2010/0096297 A1 4/2010 Stevens et al.
2010/0126395 A1 5/2010 Gauthier
2010/0126906 A1* 5/2010 Sury ..... C10G 1/045 208/30
2010/0133149 A1 6/2010 Oconnor et al.
2010/0147516 A1 6/2010 Betzer-Zilevitch
2010/0155293 A1 6/2010 Verstraete et al.
2010/0155304 A1 6/2010 Ding et al.
2010/0206772 A1 8/2010 Keppers
2010/0243534 A1 9/2010 Ng et al.
2010/0258477 A1 10/2010 Kukkonen et al.
2010/0258478 A1 10/2010 Moran et al.
2010/0264068 A1 10/2010 Ikebe et al.
2010/0276341 A1 11/2010 Speirs et al.
2010/0276983 A1 11/2010 Dunn et al.
2010/0282642 A1 11/2010 Kan
2010/0298173 A1 11/2010 Smith et al.
2010/0320133 A1 12/2010 Page et al.
2011/0005750 A1 1/2011 Borseth et al.
2011/0011769 A1* 1/2011 Sutton ..... C10G 1/045 208/45
2011/0061610 A1 3/2011 Speirs et al.
2011/0062090 A1 3/2011 Bara et al.
2011/0089013 A1 4/2011 Sakurai et al.
2011/0100931 A1 5/2011 Lake et al.
2011/0127197 A1 6/2011 Blackbourn et al.
2011/0146164 A1 6/2011 Haney et al.
2011/0174683 A1 7/2011 Cui et al.
2011/0219680 A1 9/2011 Wilkomirsky Fuica
2011/0233115 A1 9/2011 Moran et al.
2011/0265558 A1 11/2011 Feimer et al.
2011/0284428 A1 11/2011 Adeyinka et al.
2012/0000830 A1 1/2012 Monaghan et al.
2012/0000831 A1 1/2012 Moran et al.
2012/0029259 A1 2/2012 McFarlane et al.
2012/0043178 A1 2/2012 Kan
2012/0048781 A1* 3/2012 Wu ..... C10G 1/045 208/390
2012/0074044 A1 3/2012 McFarlane
2012/0074045 A1 3/2012 Stauffer
2012/0145604 A1 6/2012 Wen
2012/0175315 A1 7/2012 Revington et al.
2012/0217187 A1 8/2012 Sharma et al.
2012/0288419 A1 11/2012 Esmaeili et al.
2013/0043165 A1 2/2013 Revington et al.
2013/0081298 A1 4/2013 Bugg et al.
2013/0140249 A1 6/2013 Sury et al.
2013/0168294 A1 7/2013 Chakrabarty et al.
2013/0313886 A1 11/2013 Van Der Merwe et al.
2013/0345485 A1 12/2013 Duerr et al.
2014/0011147 A1 1/2014 Van Der Merwe
2014/0048408 A1 2/2014 Van Der Merwe et al.
2014/0048450 A1 2/2014 Van Der Merwe et al.
2014/0076785 A1 3/2014 Penner et al.
2014/0083911 A1 3/2014 Van Der Merwe et al.

FOREIGN PATENT DOCUMENTS

CA 1059052 A 7/1979
CA 1072474 A 2/1980
CA 1081641 A 7/1980
CA 1111782 A 11/1981
CA 1165712 A 4/1984
CA 1237689 A 6/1988
CA 1245990 A 12/1988
CA 1247550 A 12/1988
CA 1249414 A 1/1989
CA 1263331 A 11/1989
CA 1267860 A 4/1990
CA 1272975 A 8/1990
CA 2012305 A1 9/1990
CA 2029795 A1 5/1991
CA 1291957 C 11/1991
CA 1293465 C 12/1991
CA 2021185 A1 1/1992
CA 2053016 A1 5/1992
CA 2053086 A1 4/1993
CA 2055213 A1 5/1993
CA 2075108 A1 1/1994
CA 2098656 A1 12/1994
CA 2123076 A1 11/1995
CA 2174801 A1 10/1996
CA 2149737 A1 11/1996
CA 2165865 A1 6/1997
CA 2188064 A1 4/1998
CA 2191517 A1 5/1998
CA 2195604 A1 7/1998
CA 2200899 A1 9/1998
CA 2232929 A1 9/1998
CA 2217300 A1 3/1999
CA 2254048 A1 5/1999
CA 2350907 A1 5/2000
CA 2272045 A1 11/2000
CA 2304972 A1 10/2001
CA 2350001 A1 12/2002
CA 2353109 A1 1/2003
CA 2387257 A1 11/2003
CA 2527058 A1 3/2004
CA 2425840 A1 10/2004
CA 2454942 A1 7/2005
CA 2455011 A1 7/2005
CA 2726122 A1 7/2005
CA 2750837 A1 7/2005
CA 2750845 A1 7/2005
CA 2750934 A1 7/2005
CA 2750936 A1 7/2005
CA 2750939 A1 7/2005
CA 2750995 A1 7/2005
CA 2751587 A1 7/2005
CA 2751773 A1 7/2005

(56) References Cited

FOREIGN PATENT DOCUMENTS

| | | | |
|---|---|---|---|
| CA | 2799354 | A1 | 7/2005 |
| CA | 2799400 | A1 | 7/2005 |
| CA | 2799739 | A1 | 7/2005 |
| CA | 2520943 | A1 | 4/2006 |
| CA | 2490734 | A1 | 6/2006 |
| CA | 2502329 | A1 | 9/2006 |
| CA | 2521248 | A1 | 3/2007 |
| CA | 2524110 | A1 | 4/2007 |
| CA | 2526336 | A1 | 5/2007 |
| CA | 2567185 | A1 | 4/2008 |
| CA | 2610122 | A1 | 5/2008 |
| CA | 2610124 | A1 | 5/2008 |
| CA | 2573633 | A1 | 7/2008 |
| CA | 2673961 | A1 | 7/2008 |
| CA | 2582059 | A1 | 9/2008 |
| CA | 2588043 | A1 | 11/2008 |
| CA | 2606312 | A1 | 4/2009 |
| CA | 2610052 | A1 | 5/2009 |
| CA | 2616036 | A1 | 6/2009 |
| CA | 2654611 | A1 | 8/2009 |
| CA | 2630392 | A1 | 11/2009 |
| CA | 2669059 | A1 | 12/2009 |
| CA | 2638120 | A1 | 1/2010 |
| CA | 2673981 | A1 | 1/2010 |
| CA | 2673982 | A1 | 1/2010 |
| CA | 2641294 | A1 | 4/2010 |
| CA | 2683374 | A1 | 4/2010 |
| CA | 2643893 | A1 | 5/2010 |
| CA | 2647855 | A1 | 7/2010 |
| CA | 2649928 | A1 | 7/2010 |
| CA | 2652355 | A1 | 8/2010 |
| CA | 2653032 | A1 | 8/2010 |
| CA | 2653058 | A1 | 8/2010 |
| CA | 2689684 | A1 | 8/2010 |
| CA | 2657360 | A1 | 9/2010 |
| CA | 2657801 | A1 | 10/2010 |
| CA | 2661579 | A1 | 10/2010 |
| CA | 2711136 | A1 | 10/2010 |
| CA | 2666025 | A1 | 11/2010 |
| CA | 2708416 | A1 | 12/2010 |
| CA | 2674246 | A1 | 1/2011 |
| CA | 2708048 | A1 | 1/2011 |
| CA | 2678818 | A1 | 3/2011 |
| CA | 2701317 | A1 | 3/2011 |
| CA | 2717406 | A1 | 4/2011 |
| CA | 2729457 | A1 | 7/2011 |
| CA | 2705055 | A1 | 11/2011 |
| CA | 2768852 | A1 | 11/2011 |
| CA | 2748477 | A1 | 3/2012 |
| CA | 2752558 | A1 | 3/2012 |
| CA | 2730467 | A1 | 8/2012 |
| CA | 2735311 | A1 | 9/2012 |
| CA | 2737410 | A1 | 10/2012 |
| CA | 2740935 | A1 | 11/2012 |
| EP | 0059106 | A2 | 9/1982 |
| GB | 587798 | A | 5/1947 |
| GB | 2044796 | A | 10/1980 |
| GB | 2145730 | A | 4/1985 |
| JP | 56150407 | A | 11/1981 |
| JP | 57200402 | A | 12/1982 |
| JP | 5285415 | U | 5/1987 |
| RU | 2065455 | C1 | 8/1996 |
| RU | 2078095 | C1 | 4/1997 |
| RU | 2096438 | C1 | 11/1997 |
| WO | 2007102819 | A1 | 9/2007 |
| WO | 2009111871 | A1 | 9/2009 |
| WO | 2010088388 | A1 | 8/2010 |

OTHER PUBLICATIONS

Mitchell et al. "The solubility of asphaltenes in hydrocarbon solvents" Fuel, 1973, N. 02, vol. 52, p. 149-152 [Cited in related U.S. Appl. No. 14/002,836].

Kemp, "Pinch Analysis and Process Integration, A User Guide on Process Integration for the Efficient Use of Energy", Second edition, Elsevier 2007 [Cited in related U.S. Appl. No. 14/002,836].

Svreck et al "Successfully Specify Three-Phase Separators" Chemical Engineering Progress, Sep. 1994, p. 29-40 [Cited in related U.S. Appl. No. 14/002,836].

Svreck et al. "Design Two-Phase Separators within the Right Limits" Chemical Engineering Progress, Oct. 1993, p. 53-60 [Cited in related U.S. Appl. No. 14/002,836].

Fu et al."New technique for determination of diffusivities of volatile hydrocarbons in semi-solid bitumen", Fuel, 1979, vol. 58, August, pp. 557-560 [Cited in related U.S. Appl. No. 14/002,836].

Kamoun et al."High Speed Shadowgraphy Investigations of Superheated Liquid Jet Atomization", ILASS—Americas 22nd Annual Conference on Liquid Atomization and Spray Systems, Cincinnati Ohio, May 2010 [Cited in related U.S. Appl. No. 14/002,836].

Duan et al.s "Numerical Analyses of Flashing Jet Structure and Droplet Size Characteristics" Journal of Nuclear Science and Technology, 2006, vol. 43, No. 3, p. 285-294 [Cited in related U.S. Appl. No. 14/002,836].

Sou et al., "Effects of Cavitation in a Nozzle on liquid Jet atomization" International Journal of Heat and Mass Transfer; vol. 50, p. 3575-3582, 2007 [Cited in related U.S. Appl. No. 14/002,836].

Ransom et al., "The relaps choke flow model and application to a large scale flow test", The American Society of Mechanical Engineers, Heat Transfer Division, 1980, Saratoga, New York [Cited in related U.S. Appl. No. 14/002,836].

Power,"Froth Treatment: Past, Present Future" Oil Sand Symposium, University of Alberta, May 3-5, 2004 [Cited in related U.S. Appl. No. 14/002,836].

Rahmani, "Shear-Induced Growth of Asphaltene Aggregates" Oil Sand Symposium, University of Alberta, May 4, 2004 [Cited in related U.S. Appl. No. 14/002,836].

Blevins "Applied fluid dynamics handbook", Van Nostrand Reinhold Company 1984, p. 80-83 [Cited in related U.S. Appl. No. 14/002,836].

Wu et al., "Experimental study on steam plume and temperature distribution for sonic jet" J. Phys.: Conf.Ser. 147 2009, 012079 [Cited in related U.S. Appl. No. 14/002,836].

Yeon et al., "An Experimental Investigation of Direct Condensation of Steam Jet in Subcooled Water" Journal of Korean Nuclear Society vol. 29, No. 1, pp. 45-57, Feb. 1997 [Cited in related U.S. Appl. No. 14/002,836].

Long et al., "Structure of water/solids/asphaltenes aggregates and effect of mixing temperature on settling rate in solvent-diluted bitumen" Fuel 2004, vol. 83, p. 823-832 [Cited in related U.S. Appl. No. 14/002,836].

Rahimi et al., "Partial Upgrading of Athabasca Bitumen Froth by Asphaltene Removal", Unitar International Conference on Heavy Crude and Tar Sands, No. 1998.074, p. 1-8 [Cited in related U.S. Appl. No. 14/002,836].

Hoehenberger, "Water Treatment, Cycle Chemistry, Boiler Operation and Related Problems/Failures on Steam Generator Systems 30 bar", TUV SUD Industry Services, 2006, p. 1-14 [Cited in related U.S. Appl. No. 14/002,836].

Schroyer, "Understand the Basics of Steam Injection Heating", Chemical Engineering Progress, Hydro-Thermal Corporation, May 1997, p. 1-4 [Cited in related U.S. Appl. No. 14/002,836].

ProSonix,."Psx Steam Jet Diffuser . . . Technology That Makes a Difference", Psx Jet Diffuser Feb. 9, 2011 [Cited in related U.S. 14/002,836].

ProSonix, "ProSonix Technical Bulletin", Tb-4 Liquid Steam Pressure Relationship [Cited in related U.S. 141002,836].

ProSonix, "Psx Technical Bulletin", Tb-7 Internally Modulated Steam Control 0210 [Cited in related U.S. 14/002,836].

ProSonix, "Sparging Efficiency vs. Direct Steam Injection", Tb-6 Sparging Efficiency Performance Dec. 10, 2010 [Cited in related U.S. 14/002,836].

Siemens, "Pictures of the Future", Spring 2006, Power Plants—Siemens Global Website,http://www.siemens.com/ Innovation/en/publikationen/publications_pof/pof s- pring2006/infrastructures_articles/power_plants.htm [Cited in related U.S. 14/002,836].

George, "Mining for Oil", Scientific American, Mar. 1998, p. 84-85 [Cited in related U.S. 14/002,836].

(56) References Cited

OTHER PUBLICATIONS

Speight, "Deasphalting and Dewaxing Processes", the Chemistry and Technology of Petroleum, Fourth Edition, chapter 19, Crc Press 2006 [Cited in related U.S. 14/002,836].
Jeribi et al., "Adsorption Kinetics of Asphaltenes at Liquid Interfaces", Journal of Colloid and Interface Science, vol. 256, Issue 2, Dec. 15, 2002, pp. 268-272 [Cited in related U.S. 14/002,836].
Branan, "Pocket Guide to Chemical Engineering" Elsevier Science Technology Books, Nov. 1999 [Cited in related U.S. 14/002,836].
Perry, "Perry's Chemical Engineers Handbook" (7th Ed.), 1997 [Cited in related U.S. 14/002,836].
Clarke et al., "Asphaltenes precipitation from Cold Lake and Athabasca bitumens", Petroleum Science and Technology, 1998, 16:3-4, p. 287-305 [Cited in related U.S. 14/002,836].
Al-Atar, "Effect of Oil Compatibility and Resins/Asphaltenes Ratio on Heat Exchanger Fouling of Mixtures Containing Heavy Oil", Master Degree Thesis report, The University of British Columbia, Feb. 2000 [Cited in related U.S. Appl. No. 14/002,836].
Gearhart, "ROSE.RTM. process offers energy savings for solvent extraction", Proceedings from the Fifth Industrial Energy Technology Conference vol. II, Houston, TX, Apr. 17-20, 1983, p. 823-835 [Cited in related U.S. Appl. No. 14/002,836].
Clarke et al., "Asphaltene precipitation: detection using heat transfer analysis, and inhibition using chemical additives" Fuel, vol. 78, Issue 7, May 1997, p. 607-614 [Cited in related U.S. Appl. No. 14/002,836].
Shell Canada Limited, Application for Approval of the Jackpine Mine—Phase 1, ERCB application No. 1271285, May 2002 [Cited in related U.S. Appl. No. 14/002,836].
Imperial Oil Ressources Ventures Limited, Application for the Imperial Oil Resources Ventures Limited (Imperial Oil) and ExxonMobil Canada Properties (ExxonMobil Canada) Kearl Oil Sands Project—Mine Development (Kearl Project), ERCB Application No. 1408771, Jul. 12, 2005 [Cited in related U.S. Appl. No. 14/002,836].
Shell Canada Limited, Application for the Approval of Muskeg River Mine Project, ERCB Application No. 970588, Dec. 19, 1997 [Cited in related U.S. Appl. No. 14/002,836].
Beckman Coulter, Particle Size and Size Distribution Analysis, Coulter Counter.com, pp. 1-3 [Cited in related U.S. Appl. No. 14/002,836].
Outokumpu Technology, Slurry particle size analyzer, PSI 200 TM, 2006, pp. 1-8 [Cited in related U.S. Appl. No. 14/002,836].
Johnson, Particle size distribution in clays, Clays and Clay Minerals, pp. 89-91 [Cited in related U.S. Appl. No. 14/002,836].
Buckley et al., Solubility of the Least-Soluble Asphaltenes, Asphaltenes, Heavy Oils, and Petroleomics, Springer, 2007, Chapter 16, pp. 401-437 [Cited in related U.S. Appl. No. 14/002,836].
Gerson et al., The Relation of Surfactant Properties to the Extraction of Bitumen from Athabasca Tar Sand by a Solvent-Aqueous-Surfactant Process, Chemistry for Energy, American Chemical Society, 1979, Chapter 6, pp. 66-79 [Cited in related U.S. Appl. No. 14/002,836].
Nour et al., Characterization and Demulsification of Water-in-crude Oil Emulsions, Journal of Applied Sciences, vol. 7, Issue 10, 2007, pp. 1437-1441 [Cited in related U.S. Appl. No. 14/002,836].
Malcolmson et al., In-Line Particle Size Measurements for Cement and Other Abrasive Process Environments, for Presentation at the IEEE/PCA 40th Cement Industry Technical Conference, 1998, pp. 1-13 [Cited in related U.S. Appl. No. 14/002,836].
Bui et al., "Modelling of Viscous Resuspension Using a One-Field Description of Multiphase Flows", Third International Conference on CFD in the Minerals and Process Industries, 2003 pp. 265-268 [Cited in related U.S. Appl. No. 14/002,836].
Dispersion Technology, Inc., "Model DT-1201 . . . Acoustic and electro-acoustic spectrometer", Particle size and zeta potential measurement [Cited in related U.S. Appl. No. 14/002,836].
Csiro Minerals, UltraPS—Ultrasonic Particle Size Analyser, www.minerals.csiro.au [Cited in related U.S. Appl. No. 14/002,836].
Wedd, "Determination of Particle Size Distributions Using Laser Diffraction", Educ.Reso. For Part. Techs. 032Q-Wedd, pp. 1-4 [Cited in related U.S. Appl. No. 14/002,836].
Rahmani et al., "Settling Properties of of Asphaltene Aggregates", Abstract, Energy Fuels, 2005, 19 (3), pp. 1099-1108 [Cited in related U.S. Appl. No. 14/002,836].
Rahmani et al., "Fractal structure of asphaltene aggregates", Abstract, Journal of Colloid and Interface Science, vol. 285, Issue 2, May 15, 2005, pp. 599-608 [Cited in related U.S. Appl. No. 14/002,836].
A John Brooks Website, Spraying pumping filtering, Automated Retractable Nozzle System, FluidHandlingSolutions.com [Cited in related U.S. Appl. No. 14/002,836].
Liang et al., "Experimental and Analytical Study of Direct Contact Condensation of Steam in Water" Nucl. Eng. Des., 147, Issue 3, Apr. 1994, pp. 425-435 [Cited in related U.S. Appl. No. 14/002,836].
Peramanu et al., "Flow loop apparatus to study the effect of solvent, temperature and additives on asphaltene precipitation" Journal of Petroleum Science and Engineering, vol. 23, Issue 2, Aug. 1999, pp. 133-143 [Cited in related U.S. Appl. No. 14/002,836].
William L. Luyben, "Heat-Exchanger Bypass Control", Ind. Eng. Chem. Res. 2011, 50, 965-973 [Cited in related U.S. Appl. No. 14/002,836].
Dutta-B, "Principles of Mass Transfer and Separation Processes", p. 344, 2009 [Cited in related U.S. Appl. No. 14/002,836].
Schaschke, Carl. (2014). Dictionary of Chemical Engineering. Oxford University Press. p. 67. Online version available at:http://app.knovel.com/hotlink/toc/id:kpDCE00021/dictionary-chemical-en- gineering/dictionary-chemical-engineering [Cited in related U.S. Appl. No. 14/002,836].
Imran Ali, "Process Heating by Direct Steam Injection", Pharmaceutical Guide; Dec. 2010 [Cited in related U.S. Appl. No. 14/002,836].
Choung, J. et al., "Effect of Temperature on the Stability of Froth Formed in the Recycle Process Water of Oil Sands Extraction", The Canadian Journal of Chemical Engineering, vol. 82, Aug. 2004, pp. 801-806 [Cited in related U.S. Appl. No. 14/002,836].
Wiwchar, K. et al., "Column Flotation in an Oilsand Application", Proceedings 36th Annual Meeting of the Canadian Mineral Processors, Ottawa, Ontario, Canada, Jan. 20-22, 2004 [Cited in related U.S. Appl. No. 14/002,836].
Cleyle, P. et al., "Column Flotation Testing at Suncor Energy Inc.", Oilsand 2006 Conference, CD, University of Alberta, Feb. 22-24, 2006 [Cited in related U.S. Appl. No. 14/002,836].
Finch, J. et al. "Column Flotation", 1st ed. Pergamon Press, 1990, pp. 1-7, 75-79, 82-89, 148-149, 152-159 [Cited in related U.S. Appl. No. 14/002,836].
Baczek, "Paste Thickener Designs Evolving to Higher Capacy and Efficiencies", International Minimizing Supplement to Paste Tailing Management, Mar. 2007, 16 pages [Cited in related U.S. Appl. No. 14/002,836].
Versteeg et al., "An Introduction to Computational Fluid Dynamics: the Finite vol. Method", 2nd Edition, Pearson Prentice Hall, First published 1995 and 2nd Edition published 2007 [Cited in related U.S. Appl. No. 14/002,836].
Ferziger et al., "Computational Methods for Fluid Dynamics", 3rd Edition, Springer, 2002, pp. 142-151, 188-206, 226-245 280-307, 324-328 [Cited in related U.S. Appl. No. 14/002,836].
Godard, et al., "A Review of Suncor Energy's Millennium Extraction Process", Proceedngs 36th Annual Meeting of the Canadian Mineral Processors, Ottawa, Ontario, Canada, Jan. 20-22, 2004, pp. 141-152 [Cited in related U.S. Appl. No. 14/002,836].
Mankowski, et al., "Syncrude's Low Energy Extraction Process: Commercial Implementation", The British Library—"The world's knowledge", pp. 153-181 [Cited in related U.S. Appl. No. 14/002,836].
"Choked Flow of Gases", O'Keefe Controls Co., website; www.okcc.com [Cited in related U.S. Appl. No. 14/002,836].

* cited by examiner

PROCESS AND SYSTEM FOR SOLVENT ADDITION TO BITUMEN FROTH

REFERENCE TO RELATED APPLICATIONS

This application is a continuation application of U.S. patent application Ser. No. 14/002,836, filed Sep. 3, 2013, which is a National Stage of International Application No. PCT/CA2012/050107, filed on Feb. 23, 2012, which claims priority to Canadian Patent Application No. 2,733,862, filed on Mar. 4, 2011, the disclosures of which are incorporated by reference in their entirety.

FIELD OF THE INVENTION

The present invention generally relates to the field of oil sands processing and in particular relates to bitumen froth treatment.

BACKGROUND

Known solvent-addition and mixing technologies for combining bitumen froth and solvent, such as paraffinic solvent, in a froth treatment process, are limited and have a number of drawbacks and inefficiencies. In some prior methods, there is even a lack of fundamental understanding of the processes and phenomena involved in froth treatment which prevents developing and optimizing existing designs and operations.

In paraffinic froth treatment, for example, a paraffinic solvent is added to a bitumen froth stream and the resulting mixture is sent to a settler vessel to separate it into high diluted bitumen and solvent diluted tailings. The solvent diluted tailings of a first settler vessel may receive an addition amount of paraffinic solvent prior to being supplied into a second settler vessel. There may be several settler vessels arranged in series or in parallel. Addition of the paraffinic solvent allows separation of free water and coarse minerals from the bitumen froth and the precipitation of asphaltenes remove entrained water and fine solids out of the bitumen. The processed high diluted bitumen froth stream is then sent to a solvent recovery unit and then onward for further processing and upgrading to produce synthetic crude oil and other valuable commodities.

Conventional practices for the addition of solvent-containing streams in a froth treatment process use mixers of various configurations, which may have T-junctions, static mixers or in-line mixers. Such conventional practices focus on combining and mixing of the light and heavy hydrocarbon streams with little regard to location of injection, mixing and pipelines relative to settling vessels. In addition, some known methods attempt to control the quantity of shear imparted to the solvent diluted bitumen froth, to balance adequate mixing and avoiding over-shearing. However, the piping and mixing device arrangements in between the solvent addition and the settler vessel have been configured, located and operated without regard to certain flow characteristics, negatively affecting settling performance.

As more general background on PFT in the context of oil sands processing, extraction processes are used to liberate and separate bitumen from oil sand so the bitumen can be further processed. Numerous oil sand extraction processes have been developed and commercialized using water as a processing medium. One such water extraction process is the Clarke hot water extraction process, which recovers the bitumen product in the form of a bitumen froth stream. The bitumen froth stream produced by the Clarke hot water process contains water in the range of 20 to 45%, more typically 30% by weight and minerals from 5 to 25%, more typically 10% by weight which must be reduced to levels acceptable for downstream processes. At Clarke hot water process temperatures ranging from 40 to 80° C., bitumen in bitumen froth is both viscous and has a density similar to water. To permit separation by gravitational separation processes, commercial froth treatment processes involve the addition of a diluent to facilitate the separation of the diluted hydrocarbon phase from the water and minerals. Initial commercial froth treatment processes utilized a hydrocarbon diluent in the boiling range of 76-230° C. commonly referred to as a naphtha diluent in a two stage centrifuging separation process. Limited unit capacity, capital and operational costs associated with centrifuges promoted applying alternate separation equipment for processing diluted bitumen froth. In these processes, the diluent naphtha was blended with the bitumen froth at a weight ratio of diluent to bitumen (D/B) in the range of 0.3 to 1.0 and produced a diluted bitumen product with typically less than 4 weight percent water and 1 weight percent mineral which was suitable for dedicated bitumen upgrading processes. Generally, operating temperatures for these processes were specified such that diluted froth separation vessels were low pressure vessels with pressure ratings less than 105 kPag. Other froth separation processes using naphtha diluent involve operating temperatures that require froth separation vessels rated for pressures up to 5000 kPag. Using conventional vessel sizing methods, the cost of pressure vessels and associated systems designed for and operated at this high pressure limits the commercial viability of these processes.

Heavy oils such as bitumen are sometimes described in terms of relative solubility as comprising a pentane soluble fraction which, except for higher molecular weight and boiling point, resembles a distillate oil; a less soluble resin fraction; and a paraffinic insoluble asphaltene fraction characterized as high molecular weight organic compounds with sulphur, nitrogen, oxygen and metals that are often poisonous to catalysts used in heavy oil upgrading processes. Paraffinic hydrocarbons can precipitate asphaltenes from heavy oils to produce deasphalted heavy oil with contaminate levels acceptable for subsequent downstream upgrading processes. Contaminants tend to follow the asphaltenes when the asphaltenes are precipitated by paraffinic solvents having compositions from $C_3$ to $C_{10}$ when the heavy oil is diluted with 1 to 10 times the volume of solvent.

High water and mineral content distinguish bitumen froth from the heavy oil deasphalted in the above processes. Some early attempts to adapt deasphalting operations to processing bitumen from oil sands effected precipitation of essentially a mineral free, deasphalted product by addition of water and chemical agents.

Recent investigations and developed techniques in treating bitumen froth with paraffinic use froth settling vessels (FSV) arranged in a counter-current flow configuration. In process configurations, counter-current flow refers to a processing scheme where a process medium is added to a stage in the process to extract a component in the feed to that stage, and the medium with the extracted component is blended into the feed of the preceding stage. Counter-current flow configurations are widely applied in process operations to achieve both product quality specifications and optimal recovery of a component with the number of stages dependent on the interaction between the desired component in the feed stream and the selected medium, and the efficiency of stage separations. In deasphalting operations processing heavy oil with low mineral solids, separation using counter-current flow can be achieved within a single separation vessel. However, rapidly setting mineral particles in bitumen froth preclude using a single separation vessel as this material tends to foul internals of conventional deasphalting vessels.

A two stage paraffinic froth treatment process is disclosed in Canadian Patent No. 2,454,942 (Hyndman et al.) and represented in FIG. 1 as a froth separation plant. In a froth separation plant, bitumen froth at 80-95° C. is mixed with overflow product from the second stage settler such that the solvent to bitumen ratio in the diluted froth stream is above the threshold to precipitate asphaltenes from the bitumen froth. For paraffinic froth treatment processes with pentane as the paraffinic solvent, the threshold solvent to bitumen ratio as known in the art is about 1.2 which significantly increases the feed volume to the settler. The first stage settler separates the diluted froth into a high dilute bitumen stream comprising a partially to fully deasphalted diluted bitumen with a low water and mineral content, and an underflow stream containing the rejected asphaltenes, water, and minerals together with residual maltenes from the bitumen feed and solvent due to the stage efficiency. The first stage underflow stream is mixed with hot recycled solvent to form a diluted feed for the second stage settler. The second stage settler recovers residual maltenes and solvent to the overflow stream returned to the first stage vessel and froth separation tailings. It is important to recognize the different process functions of stages in a counter-current process configuration. In this case, the operation of first stage settler focuses on product quality and the second stage settler focuses on recovery of residual hydrocarbon from the underflow of the first stage settler.

The above known froth treatment processes involve blending diluent into bitumen froth or underflow streams or both.

Initial commercial froth treatment processes added naphtha diluent to reduce viscosity of bitumen for centrifuging. The addition of naphtha diluent also reduced the density of the hydrocarbon phase which together with the reduced viscosity permits gravitational separation of water and minerals from the hydrocarbon phase. Blending of the two streams used a single pipe tee to bring the two fluid streams together with the length of pipe upstream of the separation equipment sufficiently long to permit the streams to blend together without additional inline mixing devices. Improvements to blending of diluent and froth stream such staging the diluent addition were identified as opportunities for future commercial developments.

The initial commercial paraffinic froth treatment process as disclosed by W. Power "Froth Treatment: Past, Present & Future" Oil Sand Symposium, University of Alberta, May 2004 identified counter current of addition of paraffinic diluent as using tee and static mixing to each settler stage. Paraffin addition is also disclosed in CA 2,588,043 (Power et al.).

CA 2,669,059 (Sharma et al.) further discloses a method to design the solvent/froth feed pipe using a tee mixer and the average shear rates and residence times in the feed pipe.

In May 2004, N. Rahimi presented "Shear-Induced Growth of Asphaltene Aggregates" Oil Sand Symposium, University of Alberta, which identified shear history as important for structure and settling behaviour of asphaltene flocs with break up of aggregates by shear as rapid and not fully reversible. In addition, cyclic shear was shown to breakup asphaltene floc aggregates. The hydraulic analysis identified an improved understanding for feeding settler vessels was required for consistent separation performance both in terms of bitumen recovery and the quality of the high diluted bitumen product.

The known practices and techniques experience various drawbacks and inefficiencies, and there is indeed a need for a technology that overcomes at least some of those drawbacks and inefficiencies.

SUMMARY OF THE INVENTION

The present invention responds to the above-mentioned need by providing a process for solvent addition to bitumen froth.

In one embodiment, the invention provides a solvent treatment process for treating an bitumen-containing stream, comprising contacting the bitumen-containing stream with a solvent-containing stream to produce an in-line flow of solvent diluted material; supplying the solvent diluted material into a separation vessel such that the in-line flow thereof has sufficiently axi-symmetric phase and velocity distribution upon introduction into the separation vessel to promote stable operation of the separation vessel; and withdrawing from the separation vessel a high diluted bitumen component and a solvent diluted tailings component.

In one optional aspect, the bitumen-containing stream comprises a bitumen froth stream.

In another optional aspect, the bitumen-containing stream comprises an underflow stream from a bitumen froth separation vessel.

In another optional aspect, the contacting of the bitumen-containing stream with the solvent-containing stream comprises rapid mixing.

In another optional aspect, the rapid mixing comprises introducing the solvent-containing stream into the bitumen-containing stream via a tee junction to form a mixture; and then passing the mixture through a mixing device.

In another optional aspect, the mixing device comprises an in-line static mixer.

In another optional aspect, the rapid mixing comprises introducing the solvent-containing stream into the bitumen-containing stream via a co-annular pipeline reactor wherein the solvent-containing stream is substantially co-directionally introduced around the bitumen-containing stream to mix therewith.

In another optional aspect, the supplying of the solvent diluted material into a separation vessel comprises flowing the solvent diluted material through a feed pipeline and discharging the solvent diluted material into the separation vessel via a discharge nozzle. In another optional aspect, the feed pipeline comprises at least one fitting. In another optional aspect, the at least one fitting is selected from the group consisting of an elbow, a branch, a tee, a reducer, an enlarger and a wye. In another optional aspect, the at least one fitting comprises at least one elbow. In another optional aspect, the solvent diluted material comprises immiscible aqueous and hydrocarbon components and the at least one fitting induces pre-mature in-line separation or acceleration of the immiscible components with respect to each other.

In one optional aspect, the supplying of the solvent diluted material comprises diffusing to produce a diffused solvent diluted material prior to discharging into the separation vessel. In another optional aspect, the diffusing is performed outside of the separation vessel. The process may also include flowing the diffused solvent diluted material in a substantially linear manner into the separation vessel. In another optional aspect, the flowing of the diffused solvent diluted material is performed in a substantially vertically downward manner. The process may also include providing a linear feedwell from the diffuser to the discharge nozzle to linearly feed the diffused solvent diluted material into the separation vessel. The linear feedwell may vertically oriented. In another optional aspect, the feeding the diffused solvent diluted material to the separation vessel while avoiding contact with fittings.

In another optional aspect, the process includes straightening the solvent diluted material or the diffused solvent diluted material prior to discharging into the separation vessel.

In another optional aspect, the contacting of the bitumen-containing stream with the solvent-containing stream comprises adding a first amount of the solvent-containing stream to the bitumen-containing stream to produce an intermediate mixture; and adding a second amount of the solvent-containing stream to the intermediate mixture sufficient to produce the in-line flow of solvent diluted material. In another optional aspect, the process also includes pumping the intermediate mixture prior to adding the second amount of the solvent-containing stream.

In another optional aspect, the process also includes mixing the solvent diluted material sufficiently to attain a coefficient of variance (CoV) to promote recovery of bitumen from the separation vessel. The CoV may be up to about 5%, or is up to about 1%.

In another optional aspect, the process also includes mixing the solvent diluted material sufficiently to achieve a consistent temperature distribution throughout the solvent diluted material upon introduction into the separation vessel.

In another optional aspect, the process also includes monitoring flow rate and/or density of the bitumen-containing stream to allow flow rate control thereof.

In another optional aspect, the process also includes supplying the solvent-containing stream at a delivery pressure according to hydraulic properties of the solvent-containing stream and configuration of the contacting to achieve the in-line flow of the solvent diluted material.

In another optional aspect, the process also includes withdrawing a portion of the solvent diluted material for analysis of solvent/bitumen ratio therein and controlling addition of the solvent-containing material into the bitumen-containing material based on the solvent/bitumen ratio.

In another optional aspect, the separation vessel comprises a gravity settler vessel.

In another optional aspect, the solvent-containing stream comprises naphthenic solvent to allow separation.

In another optional aspect, the solvent-containing stream comprises paraffinic solvent to allow separation.

In another optional aspect, the solvent diluted material is a paraffin diluted material containing diluted bitumen and precipitated aggregates comprising asphaltenes, fine solids and coalesced water and the supplying of the paraffin diluted material into the separation vessel is performed such that the axi-symmetric phase and velocity distribution of the in-line flow is sufficient to promote integrity and settling of the precipitated aggregates.

In another optional aspect, the supplying is performed to avoid in-line settling of the precipitated aggregates.

In another optional aspect, the contacting and the supplying comprise providing a cumulative Camp number up to discharge into the separation vessel between about 5,000 and about 12,000.

In another optional aspect, the process also includes conditioning the solvent diluted material to promote densification while avoiding overshearing the precipitated aggregates prior to introduction into the separation vessel.

In another optional aspect, the process also includes pressurizing the separation vessel to a pressure according to upstream pressure of the in-line flow of the solvent diluted material to avoid low pressure points and/or cavitations in the in-line flow to avoid compromising formation of the precipitated aggregates.

In another optional aspect, the separation vessel is a first stage gravity settler vessel, the bitumen-containing stream is a bitumen froth stream and the solvent-containing stream is a first stage solvent-containing stream, the process further comprising subjecting the high diluted bitumen component to solvent separation to produce a recovered solvent component; contacting the solvent diluted tailings withdrawn from the first stage gravity settler vessel with a second stage solvent stream containing the recovered solvent to form a second stage solvent diluted material; supplying the second stage solvent diluted material to a second stage gravity settler vessel; withdrawing from the second stage gravity settler vessel a second stage solvent diluted tailings component and a second stage solvent diluted bitumen component; recycling the second stage solvent diluted bitumen component as at least part of the first stage solvent-containing stream; subjecting the second stage solvent diluted tailings component to solvent recovery to produce a second stage recovered solvent component; and providing the second stage recovered solvent component as part of the second stage solvent stream.

In another optional aspect, the process also includes adding an amount of trim solvent to the first stage solvent-containing stream to maintain stable operation of the second stage gravity settler vessel.

In another optional aspect, the process also includes controlling pressure of the separation vessel with purge gas.

In an embodiment, the invention provides a solvent treatment system for treating a bitumen-containing stream, comprising a solvent addition device for contacting the bitumen-containing stream with a solvent-containing stream to produce an in-line flow of solvent diluted material; a separation vessel for separating the solvent diluted material into a high diluted bitumen component and a solvent diluted tailings component; a supply line for supplying the solvent diluted material into the separation vessel; and wherein the solvent addition pipeline reactor and the supply line are sized and configured so as to provide the in-line flow of the solvent diluted material with sufficiently axi-symmetric phase and velocity distribution upon introduction into the separation vessel to promote stable operation of the separation vessel.

In one optional aspect, the solvent addition device comprises a tee junction followed by a static mixer.

In another optional aspect, the solvent addition device comprises a co-annular pipeline reactor wherein the solvent-containing stream is substantially co-directionally introduced around the bitumen-containing stream to mix therewith.

In another optional aspect, the supply line comprises a feed pipeline and a discharge nozzle.

In another optional aspect, the feed pipeline comprises at least one fitting.

In another optional aspect, the at least one fitting is selected from the group consisting of an elbow, a branch, a tee, a reducer, an enlarger and a wye.

In another optional aspect, the at least one fitting comprises at least one elbow.

In another optional aspect, the solvent diluted material comprises immiscible aqueous and hydrocarbon components and the at least one fitting has a configuration that induces pre-mature in-line separation or acceleration of the immiscible components with respect to each other.

In another optional aspect, the system also includes a diffuser connected to the supply line upstream of the separation vessel for diffusing the solvent diluted material to produce a diffused solvent diluted material for discharging through the discharge nozzle into the separation vessel. In another optional aspect, the diffuser is provided outside of the separation vessel. In another optional aspect, the feed pipeline comprises a linear section extending from the diffuser to the discharge nozzle for providing the diffused solvent diluted material in a substantially linear manner into the separation vessel. In another optional aspect, the linear section of the feed line is substantially vertical. The linear section of the feed line may be fitting less.

In another optional aspect, the system includes a straightener connected to the supply line downstream of the diffuser for straightening the solvent diluted material or the diffused solvent diluted material.

In another optional aspect, the solvent addition device comprises a first solvent addition device for adding an amount of the solvent-containing stream to the bitumen-containing stream to produce an intermediate mixture; and a second solvent addition device downstream from the first solvent addition device for adding an amount of the solvent-containing stream to the intermediate mixture sufficient to produce the in-line flow of solvent diluted material.

In another optional aspect, the system includes a pump arranged in between the first solvent addition device and the second solvent addition device for pumping the intermediate mixture.

In another optional aspect, the solvent addition device is configured to provide mixing of the solvent diluted material sufficient to attain a coefficient of variance (CoV) to promote recovery of bitumen from the separation vessel.

In another optional aspect, the solvent addition device is configured to provide the CoV of about 5% or lower. In another optional aspect, the solvent addition device is configured to provide the CoV of about 1% or lower.

In another optional aspect, the solvent-containing stream comprises naphthenic solvent to allow separation.

In another optional aspect, the solvent-containing stream comprises paraffinic solvent to allow separation.

In another optional aspect, the solvent diluted material is a paraffin diluted material containing diluted bitumen and precipitated aggregates comprising asphaltenes, fine solids and coalesced water and the supply line is configured such that the axi-symmetric phase and velocity distribution of the in-line flow is sufficient to promote integrity and settling of the precipitated aggregates.

In another optional aspect, the supply line is sized and configured to avoid in-line settling of the precipitated aggregates.

In another optional aspect, the solvent addition device and the supply line are sized and configured to provide a cumulative Camp number up to discharge into the separation vessel between about 5,000 and about 12,000.

In another optional aspect, the supply line is sized and configured to condition the solvent diluted material to promote densification while avoiding overshearing the precipitated aggregates prior to introduction into the separation vessel.

In another optional aspect, the system includes pressurization means for pressurizing the separation vessel to a pressure according to upstream pressure of the supply line and the solvent addition device to avoid low pressure points and/or cavitations to avoid compromising formation of the precipitated aggregates.

In another optional aspect, the separation vessel is a first stage gravity settler vessel, the bitumen-containing stream is a bitumen froth stream and the solvent-containing stream is a first stage solvent-containing stream, the system further comprising: a solvent separation apparatus for receiving the high diluted bitumen component and recovering a recovered solvent there-from; a second stage solvent addition device for contacting the solvent diluted tailings withdrawn from the first stage gravity settler vessel with a second stage solvent stream containing the recovered solvent to form a second stage solvent diluted material; a second stage gravity settler vessel for receiving the second stage solvent diluted material and producing a second stage solvent diluted tailings component and a second stage solvent diluted bitumen component; a recycle line for recycling the second stage solvent diluted bitumen component as at least part of the first stage solvent-containing stream; and a tailing solvent recovery apparatus receiving the second stage solvent diluted tailings component and producing a second stage recovered solvent component which is provided as part of the second stage solvent stream.

In another optional aspect, the system includes a trim solvent line for adding an amount of trim solvent to the first stage solvent-containing stream to maintain stable operation of the second stage gravity settler vessel.

In another optional aspect, the system includes pressure control means for controlling pressure of the separation vessel with purge gas.

In one embodiment, the invention provides a solvent treatment process for treating an bitumen-containing stream, comprising contacting the bitumen-containing stream with a solvent-containing stream to produce an in-line flow of solvent diluted material comprising immiscible aqueous and hydrocarbon components; transporting the solvent diluted material toward a separation vessel; diffusing the solvent diluted material prior to introduction into the separation vessel to produce a diffused solvent diluted material with reduced velocity gradients between the immiscible aqueous and hydrocarbon components; introducing the diffused solvent diluted material into the separation vessel; and withdrawing from the separation vessel a high diluted bitumen component and a solvent diluted tailings component.

In another optional aspect, the transporting of the solvent diluted material comprises contact with at least one fitting.

In another optional aspect, the at least one fitting is selected from the group consisting of an elbow, a branch, a tee, a reducer, an enlarger and a wye.

In another optional aspect, the at least one fitting comprises at least one elbow.

In another optional aspect, the transporting of the solvent diluted material induces pre-mature separation or acceleration of the immiscible aqueous and hydrocarbon components with respect to each other.

In another optional aspect, the diffusing is performed outside of the separation vessel.

In another optional aspect, the system includes flowing the diffused solvent diluted material in a substantially linear manner into the separation vessel.

In another optional aspect, the flowing of the diffused solvent diluted material is performed in a substantially vertically downward manner.

In another optional aspect, the system includes providing a linear feedwell from the diffuser to a discharge nozzle located with in the separation vessel to linearly feed the diffused solvent diluted material into the separation vessel.

In another optional aspect, the system includes feeding the diffused solvent diluted material to the separation vessel while avoiding contact with fittings.

In another optional aspect, the system includes straightening the diffused solvent diluted material.

In one embodiment, the invention provides a solvent treatment system for treating an bitumen-containing stream, comprising a solvent addition device for contacting the bitumen-containing stream with a solvent-containing stream to produce an in-line flow of solvent diluted material comprising immiscible aqueous and hydrocarbon components; a separation vessel for separating the solvent diluted material into a high diluted bitumen component and a solvent diluted tailings component; a supply line for supplying the solvent diluted material into the separation vessel; and a diffuser connected to the supply line for diffusing the solvent diluted material prior to introduction into the separation vessel to produce a diffused solvent diluted material with reduced velocity gradients between the immiscible aqueous and hydrocarbon components.

In another optional aspect, the supply line comprises at least one fitting upstream of the diffuser.

In another optional aspect, the at least one fitting is selected from the group consisting of an elbow, a branch, a tee, a reducer, an enlarger and a wye.

In another optional aspect, the at least one fitting comprises at least one elbow.

In another optional aspect, the supply line has a size and configuration which cause pre-mature separation or acceleration of the immiscible aqueous and hydrocarbon components with respect to each other and the diffuser is located so as to redistribute phase and velocity of the solvent diluted material.

In another optional aspect, the diffuser is located outside of the separation vessel.

In another optional aspect, the supply line comprises a linear section extending from the diffuser to a discharge nozzle located within the separation vessel for providing the diffused solvent diluted material in a substantially linear manner into the separation vessel.

In another optional aspect, the linear section of the supply line is substantially vertical.

In another optional aspect, the linear section of the supply line is fittingless.

In another optional aspect, the system includes a straightener provided downstream of the diffuser.

In another embodiment, the invention provides a solvent treatment process for treating an bitumen-containing stream, comprising contacting the bitumen-containing stream with a solvent-containing stream in a co-annular pipeline reactor wherein the solvent-containing stream is co-directionally introduced around the bitumen-containing stream to mix together and form an in-line flow of solvent diluted material; supplying the solvent diluted material into a separation vessel; and withdrawing from the separation vessel a high diluted bitumen component and a solvent diluted tailings component.

In another optional aspect, the co-annular pipeline reactor comprises a central channel through which the bitumen-containing stream is allowed to travel; a solvent conduit disposed co-annularly with respect to the central channel and configured for providing the solvent-containing stream; and a mixing region downstream and in fluid connection with the central channel and the solvent conduit, the mixing region having side walls and being sized and configured to be larger than the central channel to receive the bitumen-containing stream in comprising turbulence eddies and the solvent-containing stream along the side walls to mix with the turbulence eddies.

In another optional aspect, the co-annular pipeline reactor comprises a conditioning region downstream and in fluid connection with the mixing region.

In another optional aspect, the central conduit is inwardly tapered in the flow direction.

In another optional aspect, the solvent conduit has an single aperture arranged entirely around the central channel.

In another optional aspect, the bitumen-containing stream is provided at a flow rate between about 0.5 m/s and about 1.5 m/s.

In another optional aspect, the solvent-containing stream is provided at a flow rate between about 2.0 m/s and about 4.0 m/s.

In another optional aspect, the in-line flow of the solvent diluted material is provided at a flow rate sufficient to avoid minerals from settling prior to introduction into the separation vessel.

In another optional aspect, the in-line flow of the solvent diluted material is provided at a flow rate above about 2.5 m/s.

In another optional aspect, the co-annular pipeline reactor is cylindrical.

In another optional aspect, the process includes providing a static mixer downstream of the co-annular pipeline reactor.

In another optional aspect, the process also includes diffusing the solvent diluted material prior to introduction into the separation vessel to produce a diffused solvent diluted material with reduced velocity gradients between immiscible aqueous and hydrocarbon components.

In another optional aspect, the co-annular pipeline reactor is a first co-annular pipeline reactor and the contacting of the bitumen-containing stream with the solvent-containing stream comprises adding a first amount of the solvent-containing stream to the bitumen-containing stream in the first co-annular pipeline reactor to produce an intermediate mixture; and adding a second amount of the solvent-containing stream to the intermediate mixture in a second co-annular pipeline reactor, wherein the second amount is sufficient to produce the in-line flow of solvent diluted material.

In another optional aspect, the process includes pumping the intermediate mixture prior to adding the second amount of the solvent-containing stream.

In another optional aspect, the co-annular pipeline reactor is sized and configured to produce and mix the solvent diluted material sufficiently to attain a coefficient of variance (CoV) to promote recovery of bitumen from the separation vessel. In another optional aspect, the CoV is about 5% or lower. In another optional aspect, the CoV is about 1% or lower.

In another optional aspect, the solvent-containing stream comprises naphthenic solvent to allow separation.

In another optional aspect, the solvent-containing stream comprises paraffinic solvent to allow separation.

In another optional aspect, the solvent diluted material is a paraffin diluted material containing diluted bitumen and precipitated aggregates comprising asphaltenes, fine solids and coalesced water and the supplying of the paraffin diluted material into the separation vessel is performed such that the in-line flow has sufficient axi-symmetric phase and velocity distribution to promote integrity and settling of the precipitated aggregates.

In another optional aspect, the contacting and the supplying comprise providing a cumulative Camp number up to discharge into the separation vessel between about 5,000 and about 12,000.

In another optional aspect, the process includes conditioning the solvent diluted material to promote densification while avoiding overshearing the precipitated aggregates prior to introduction into the separation vessel.

In another optional aspect, the separation vessel is a first stage gravity settler vessel, the bitumen-containing stream is a bitumen froth stream and the solvent-containing stream is a first stage solvent-containing stream, the process further comprising subjecting the high diluted bitumen component to solvent separation to produce a recovered solvent component; contacting the solvent diluted tailings withdrawn from the first stage gravity settler vessel with a second stage solvent stream containing the recovered solvent to form a second stage solvent diluted material; supplying the second stage solvent diluted material to a second stage gravity settler vessel; withdrawing from the second stage gravity settler vessel a second stage solvent diluted tailings component and a second stage solvent diluted bitumen component; recycling the second stage solvent diluted bitumen component as at least part of the first stage solvent-containing stream; subjecting the second stage solvent diluted tailings component to solvent recovery to produce a second stage recovered solvent component; providing the second stage recovered solvent component as part of the second stage solvent stream.

In yet another embodiment, the invention provides a solvent treatment process for treating a high viscosity bitumen-containing stream, comprising contacting the high viscosity bitumen-containing stream with a solvent-containing stream having a lower viscosity in a pipeline reactor comprising interior pipe walls, such that the solvent-containing stream is present between the interior pipe walls and the bitumen-containing stream during initial mixing between the high viscosity bitumen-containing stream with a solvent-containing stream; mixing the high viscosity bitumen-containing stream with a solvent-containing stream sufficiently to produce an in-line flow of a solvent diluted material; supplying the solvent diluted material into a separation vessel; and withdrawing from the separation vessel a high diluted bitumen component and a solvent diluted tailings component.

In another optional aspect, the pipeline reactor is a co-annular pipeline reactor comprising a central channel through which the bitumen-containing stream is allowed to travel; a solvent conduit disposed co-annularly with respect to the central channel and configured for providing the solvent-containing stream; and a mixing region downstream and in fluid connection with the central channel and the solvent conduit, the mixing region having side walls and being sized and configured to be larger than the central channel to receive the bitumen-containing stream in comprising turbulence eddies and the solvent-containing stream along the side walls to mix with the turbulence eddies.

In another optional aspect, the co-annular pipeline reactor comprises a conditioning region downstream and in fluid connection with the mixing region.

In another optional aspect, the central conduit is inwardly tapered in the flow direction.

In another optional aspect, the solvent conduit has a single aperture arranged entirely around the central channel.

In another optional aspect, the bitumen-containing stream is provided at a flow rate between about 0.5 m/s and about 1.5 m/s.

In another optional aspect, the solvent-containing stream is provided at a flow rate between about 2.0 m/s and about 4.0 m/s.

In another optional aspect, the in-line flow of the solvent diluted material is provided at a flow rate sufficient to avoid minerals from settling prior to introduction into the separation vessel.

In another optional aspect, the in-line flow of the solvent diluted material is provided at a flow rate above about 2.5 m/s.

In another optional aspect, the process includes providing a static mixer downstream of the pipeline reactor.

In another optional aspect, the process includes diffusing the solvent diluted material prior to introduction into the separation vessel to produce a diffused solvent diluted material with reduced velocity gradients between immiscible aqueous and hydrocarbon components.

In another optional aspect, the pipeline reactor is a first pipeline reactor and the contacting of the bitumen-containing stream with the solvent-containing stream comprises adding a first amount of the solvent-containing stream to the bitumen-containing stream in the first pipeline reactor to produce an intermediate mixture; and adding a second amount of the solvent-containing stream to the intermediate mixture in a second pipeline reactor, wherein the second amount is sufficient to produce the in-line flow of solvent diluted material.

In another optional aspect, the process includes pumping the intermediate mixture prior to adding the second amount of the solvent-containing stream.

In another optional aspect, the solvent-containing stream comprises naphthenic solvent to allow separation.

In another optional aspect, the solvent-containing stream comprises paraffinic solvent to allow separation.

In another optional aspect, the solvent diluted material is a paraffin diluted material containing diluted bitumen and precipitated aggregates comprising asphaltenes, fine solids and coalesced water and the supplying of the paraffin diluted material into the separation vessel is performed such that the in-line flow has sufficient axi-symmetric phase and velocity distribution to promote integrity and settling of the precipitated aggregates.

In another optional aspect, the contacting and the supplying comprise providing a cumulative Camp number up to discharge into the separation vessel between about 5,000 and about 12,000.

In another optional aspect, the process also includes conditioning the solvent diluted material to promote densification while avoiding overshearing the precipitated aggregates prior to introduction into the separation vessel.

In another optional aspect, the separation vessel is a first stage gravity settler vessel, the bitumen-containing stream is a bitumen froth stream and the solvent-containing stream is a first stage solvent-containing stream, the process further comprising subjecting the high diluted bitumen component to solvent separation to produce a recovered solvent component; contacting the solvent diluted tailings withdrawn from the first stage gravity settler vessel with a second stage solvent stream containing the recovered solvent to form a second stage solvent diluted material; supplying the second stage solvent diluted material to a second stage gravity settler vessel; withdrawing from the second stage gravity settler vessel a second stage solvent diluted tailings component and a second stage solvent diluted bitumen component; recycling the second stage solvent diluted bitumen component as at least part of the first stage solvent-containing stream; subjecting the second stage solvent diluted tailings component to solvent recovery to produce a second stage recovered solvent component; and providing the second stage recovered solvent component as part of the second stage solvent stream.

In a further embodiment, the invention provides a process for treating a high viscosity oil sands liquid stream containing bitumen with a low viscosity liquid stream, comprising contacting the high viscosity oil sands liquid stream with the low viscosity liquid stream in a pipeline reactor comprising interior pipe walls, such that the low viscosity liquid stream is present between the interior pipe walls and the high viscosity oil sands liquid stream during initial mixing therebetween; subjecting the contacted high viscosity oil sands liquid stream and the low viscosity liquid stream to in-line mixing sufficient to produce an in-line flow of an oil sands mixture stream; and supplying the oil sands mixture stream into a unit operation. The unit operation may preferably be a separation operation.

In one optional aspect, the high viscosity oil sands liquid stream is a bitumen-containing stream.

In another optional aspect, the bitumen-containing stream is a bitumen froth stream.

In another optional aspect, the low viscosity liquid stream is a solvent-containing stream.

In another optional aspect, the solvent-containing stream is a paraffinic solvent containing stream.

In another optional aspect, the solvent-containing stream is a naphthenic solvent containing stream.

In another optional aspect, the oil sands mixture stream is a solvent diluted material and the process further comprises supplying the solvent diluted material into a separation vessel; and withdrawing from the separation vessel a high diluted bitumen component and a solvent diluted tailings component.

In yet a further embodiment, the invention provides a paraffinic treatment process for treating a bitumen-containing stream, comprising an in-line mixing stage comprising mixing of the bitumen-containing stream with a paraffinic solvent-containing stream to produce an in-line flow of paraffin diluted material containing precipitated aggregates comprising asphaltenes, fine solids and water; an in-line conditioning stage comprising imparting sufficient energy to the in-line flow to allow build-up and densification of the precipitated aggregates while avoiding overshear breakup thereof; and a discharge stage comprising discharging the in-line flow into a separation vessel to allow separation of the precipitated aggregates in a solvent diluted tailings component from a high diluted bitumen component.

In another optional aspect, the bitumen-containing stream comprises a bitumen froth stream.

In another optional aspect, the bitumen-containing stream comprises an underflow stream from a bitumen froth separation vessel.

In another optional aspect, the in-line mixing stage comprises introducing the solvent-containing stream into the bitumen-containing stream via a tee junction to form a mixture; and then passing the mixture through a mixing device.

In another optional aspect, the mixing device comprises an in-line static mixer.

In another optional aspect, the in-line mixing stage comprises introducing the solvent-containing stream into the bitumen-containing stream via a co-annular pipeline reactor wherein the solvent-containing stream is substantially co-directionally introduced around the bitumen-containing stream to mix therewith.

In another optional aspect, the in-line conditioning stage comprises supplying the solvent diluted material into the separation vessel such that the in-line flow thereof has sufficiently axi-symmetric phase and velocity distribution upon introduction into the separation vessel to promote integrity and settling of the precipitated aggregates.

In another optional aspect, the in-line conditioning stage comprises flowing the solvent diluted material through a feed pipeline and discharging the solvent diluted material into the separation vessel via a discharge nozzle.

In another optional aspect, the in-line mixing stage comprises adding a first amount of the solvent-containing stream to the bitumen-containing stream to produce an intermediate mixture; and adding a second amount of the solvent-containing stream to the intermediate mixture sufficient to produce the in-line flow of solvent diluted material.

In another optional aspect, the process also includes pumping the intermediate mixture prior to adding the second amount of the solvent-containing stream.

In another optional aspect, the in-line mixing and conditioning stages provide a cumulative Camp number up to discharge into the separation vessel between about 5,000 and about 12,000.

In another optional aspect, the process includes pressurizing the separation vessel to a pressure according to upstream pressure in the in-line mixing and conditioning stages to avoid low pressure points and/or cavitations in the in-line flow to avoid compromising formation of the precipitated aggregates.

In another optional aspect, the in-line conditioning stage comprises diffusing the solvent diluted material to produce a diffused solvent diluted material.

In another optional aspect, the in-line conditioning stage comprises straightening the diffused solvent diluted material.

In another optional aspect, the in-line conditioning stage comprises straightening the solvent diluted material.

In another optional aspect, the separation vessel is a first stage gravity settler vessel, the bitumen-containing stream is a bitumen froth stream and the solvent-containing stream is a first stage solvent-containing stream, the process further comprising subjecting the high diluted bitumen component to solvent separation to produce a recovered solvent component; contacting the solvent diluted tailings withdrawn from the first stage gravity settler vessel with a second stage solvent stream containing the recovered solvent to form a second stage solvent diluted material; supplying the second stage solvent diluted material to a second stage gravity settler vessel; withdrawing from the second stage gravity settler vessel a second stage solvent diluted tailings component and a second stage solvent diluted bitumen component; recycling the second stage solvent diluted bitumen component as at least part of the first stage solvent-containing stream; subjecting the second stage solvent diluted tailings component to solvent recovery to produce a second stage recovered solvent component; and providing the second stage recovered solvent component as part of the second stage solvent stream.

DETAILED DESCRIPTION

Referring to FIGS. 1, 4, 5 and 6, which illustrate embodiments of a pipeline reactor 10 according to the present invention, a main input fluid 12 is provided for combination with an additive fluid 14. The main input fluid 12 may be bitumen froth derived from an oil sands mining and extraction operation (not illustrated) or an in situ recovery operation (not illustrated) or a blend of both. The main input fluid 12 may also be an underflow stream of a froth treatment process, which may use paraffinic or naphthenic solvent. The pipeline reactor 10 may be used in a variety of different stages within the froth treatment process, which will be further discussed herein below.

Figure 1:
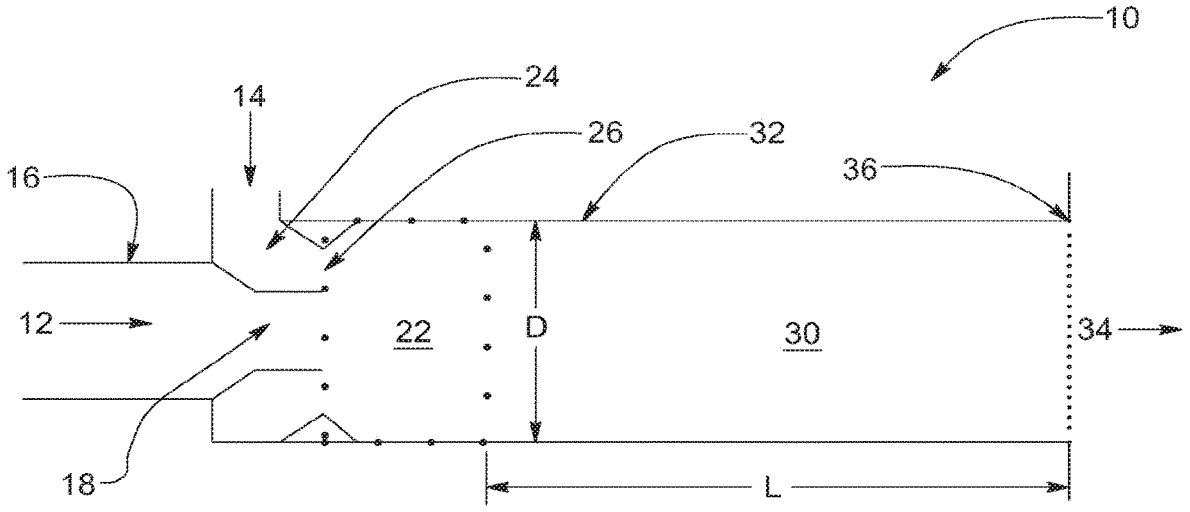
FIG. 1 is a plan cross-sectional view of a solvent addition pipeline reactor according to an embodiment of the present invention.

Referring particularly to FIG. 1, which illustrates a "basic" pipeline reactor 10 according to an embodiment of the present invention, the bitumen froth or underflow 12 is supplied via a pipe 16 to the pipeline reactor 10. The pipeline reactor 10 includes a mixer section 18 to which the bitumen froth or underflow 12 is supplied. In the mixer section 18, the bitumen froth or underflow 12 flows through an orifice 20 or similar baffle arrangement to accelerate the froth or underflow 12 such that the discharge out of the orifice 20 develops turbulence eddies in a mixing zone 22. The additive fluid 14, which is this case is paraffinic solvent 14, is introduced through an annular region 24 for distribution via at least one solvent aperture 26, which may be defined as a restriction that jets the solvent 14 into the mixing zone 22.

Two preferred criteria regarding the configuration of the annular region 24 and operation of the fluid flowing therethrough are the following. Firstly, in the case of mixing miscible components with a large difference in viscosities and different viscosities, preferred mixing is achieved if the high viscosity medium is introduced into the low viscosity medium such that the low viscosity medium remains predominantly in contact with the pipe walls until mixing is achieved, i.e. the main input fluid 12 is the low viscosity medium and the additive fluid 14 is the high viscosity fluid. Secondly, the solvent 14 is preferably introduced into the annular region 24 in such a manner as to prevent a non-uniform flow profile leaving the annular region through the solvent apertures 26 when entering the mixing zone 22. This may be ensured by a number of means, including hydraulic analysis and basic engineering principles of fluid dynamics. Computation fluid dynamics (CFD) is a tool that may be used to ensure the design meets both requirements in a timely and cost effective manner. The preferred configuration and operation of the fluid flowing through the annular region account for these variables to ensure uniform three-dimensional feed from the annular region to the mixing zone. CFD methods permit testing for achieving, for example, jetting of the solvent, mixing and dispersion levels within the mixing zone, or axi-symmetric flow.

Referring still to FIG. 1, in one embodiment of the present invention, the orifice 20 and the apertures 26 induce a combined turbulence on the bitumen froth 12 and the paraffinic solvent 14, causing an initial dispersion of solvent 14 into the bitumen froth 12 resulting in a rapid mixing of the two streams into a solvent diluted froth stream.

Figure 7A:
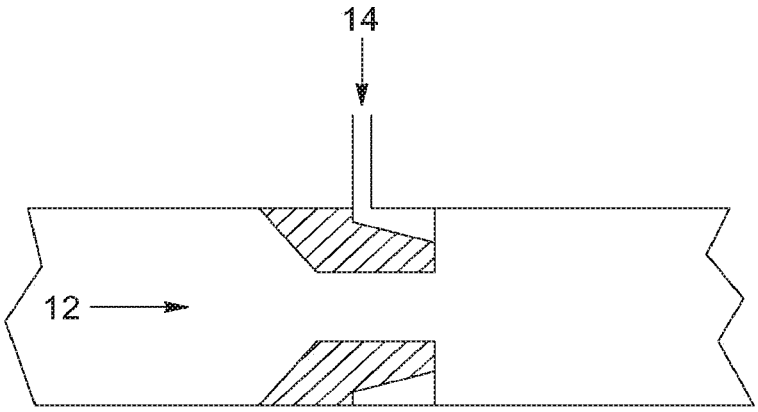
FIGS. 7*a*-7*c* are plan cross-sectional views of solvent addition pipeline reactor configurations according to variants of embodiments of the present invention.
Figure 7B:
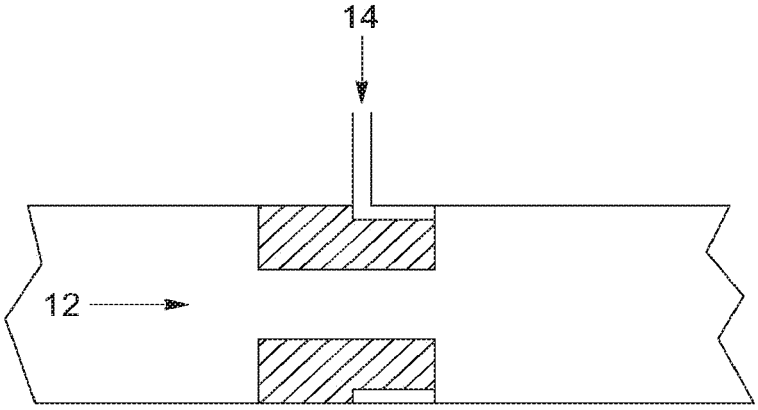
Figure 7C:
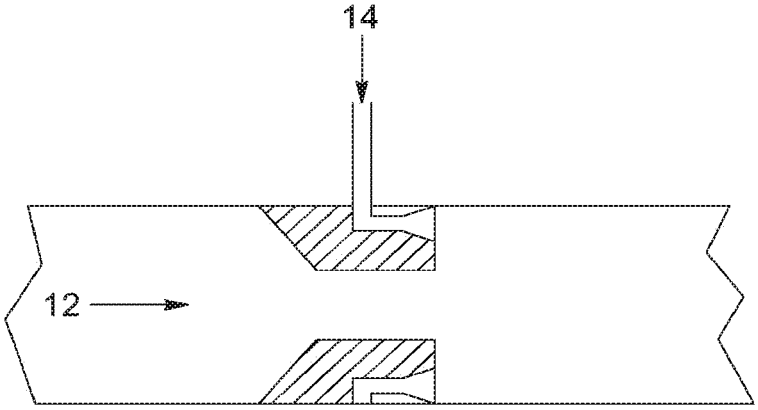

Referring to FIGS. 7*a*-7*c*, the pipeline reactor 10 may have a variety of different generally co-annular configurations to achieve addition of the solvent 14 into the bitumen froth 12.

Figure 2:
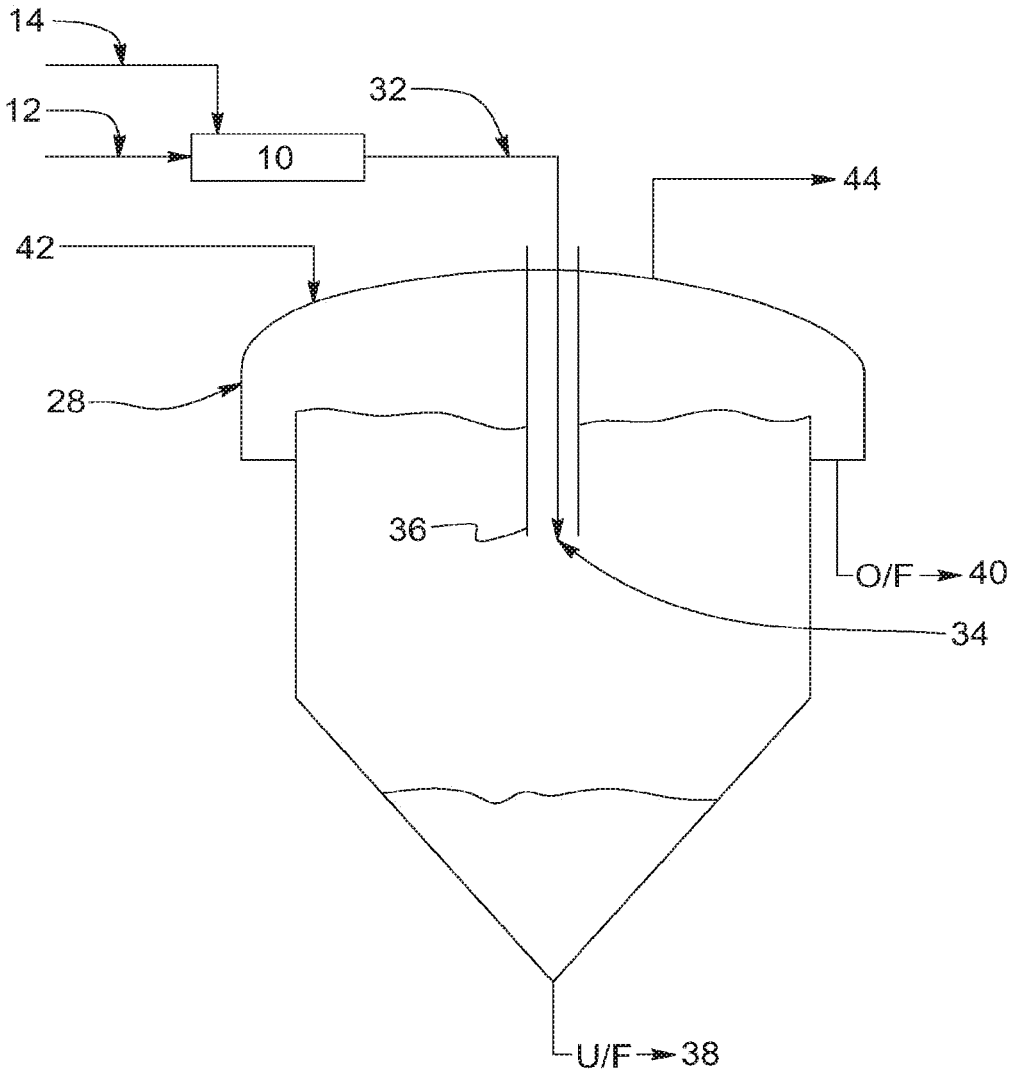
FIG. 2 is a plan cross-sectional view of a paraffinic froth treatment (PFT) system including a froth settling vessel (FSV) according to another embodiment of the present invention.
Figure 3:
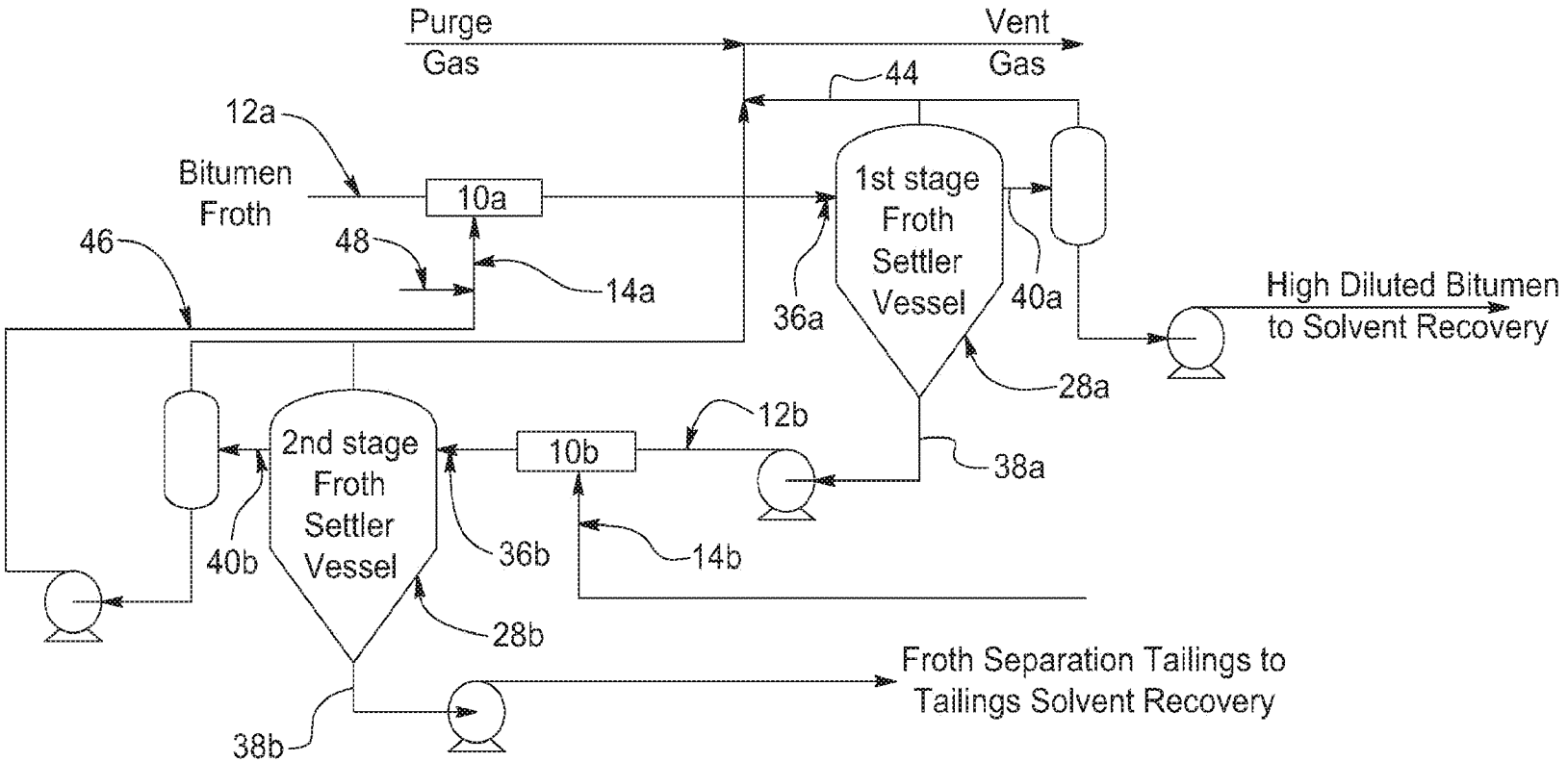
FIG. 3 is a process flow diagram of a paraffinic froth settling system for a PFT process, according to another embodiment of the present invention.

Referring briefly to FIGS. 2 and 3, the solvent diluted froth stream is supplied to a froth settler vessel 28, which may be a first stage froth settler vessel 28*a* or a second stage froth settler vessel 28*b*.

In one preferred aspect of the present invention used in PFT, the rapid mixing of the bitumen froth and paraffinic solvent is performed by providing froth velocity such that turbulence exists to effect the mixing without imparting shear in sufficient quantity or duration that would damage coalesced or flocculated structures in the solvent diluted froth stream. Coalesced or flocculated structures directly impact the separation in the froth separation vessel 28. For flocculation processes involving long chain polymers, shear at the appropriate level creates entanglement of the flocculating chains and consolidation of the structures without breakage. For PFT coalesced or flocculated structures, this kind of entanglement does not exist; rather, structures may stick and compress or existing structures with high voidage may comprises to form denser and higher settling structures. One may refer to such PFT structures as densified settling structures. Even among such structures, there are higher density settling structures and lower density settling structures. Excessive shear can break apart the lower density settling structures, which have higher voidage and are held together weakly by precipitated asphaltene bonds and viscous forces. Breakage of such lower density settling structures may decrease settling efficiency and re-suspend the broken material in the fluid, thus decreasing the efficiency of the settling separation operation.

Referring now to FIGS. 1, 4, 5, and 6 the solvent diluted froth stream flows through a pipeline conditioning zone 30 of the pipeline reactor 10 prior to being introduced into the settling vessel (28 in FIGS. 2 and 3). More regarding the pipeline conditioning zone 30 will be discussed hereinbelow.

Referring to FIG. 1, the pipeline reactor 10 is preferably constructed to have a cylindrical pipe section 32 having an internal diameter D and length L that provides energy input by hydraulic shear stresses. Such energy input by hydraulic shear stresses enables coagulation of free water droplets and flocculation of asphaltene droplets together with finely dispersed water droplets and minerals linked to asphaltene molecules, to produce a conditioned PFT settler feed stream 34. With optimum conditioning, the settling vessel produces a clean high diluted bitumen product. Of course, it should be understood that the pipe section 32 and other sections and components of the pipeline reactor may have different forms and orientations not illustrated in the Figs, and are not restricted to cylindrical, straight or horizontal configurations. The pipe section 32 preferably includes fittings and in some cases baffles in situations where layout may constrain the length of the pipeline reactor such that the equivalent length of pipe can provide the energy input for forming the coalesced or flocculated paraffin-asphaltene-water structures while avoiding overshear of those structures.

Referring to FIG. 2, the conditioned settler feed stream 34 is fed into the FSV 28 via a discharge nozzle 36. The discharge nozzle 36 preferably comprises a single aperture at the end of the feedwell located within the vessel 28. The discharge nozzle may be an end of pipe or custom made nozzle. In the preferred cost-effective design, the discharge nozzle is robust and structurally simple providing advantageous predictability, balanced fluid flow and distribution and effective treatment to avoid upsetting floc structure in the froth treatment process. The discharge nozzle 36 is preferably located within the vessel 38 in a central location that is equidistant from the surrounding side walls. It should nevertheless be understood that the discharge arrangement could alternatively include multiple inlets which may be located and controlled in a variety of ways.

Referring now to FIG. 1, internal diameters of the components of the pipeline reactor 10, including the bitumen froth pipe 16, orifice 20, annular region 24, apertures 26, and mixing and conditioning pipe 32, are based on fluid volumes and are in part offset by fluid velocities due to particular fluid properties. Bitumen froth pipelines preferably operate at about 0.5 m/s to about 1.5 m/s due to high fluid viscosities, which limits settling of minerals while increasing pressure losses. Solvent pipelines preferably operate at about 2.0 m/s to about 4.0 m/s reflecting the low fluid viscosity and associated pressure losses. Solvent diluted froth pipelines typically operate over about 2.5 m/s as minerals can settle from diluted froth in horizontal or vertical up-flow piping sections which could lead to operational issues.

In one embodiment of the present invention, the mixture is blended to have a preferred coefficient of variation (CoV) to maximize both bitumen recovery into the high diluted bitumen product and the quality of the product. The preferred CoV may be determined, pre-set or managed on an ongoing basis. CoV is a measure of the relative uniformity of the blended mixture. In one optional aspect, CoV may be up to about 5% and optionally about 1% as lower target. With uniform blending, both asphaltene rejection and water coalescence occur in a generally uniform manner across the pipe diameter D of the pipeline reactor 10. Poor mixing can result in over-flocculation or over-coalescence in high solvent concentration zones and little to no flocculation or coalescence in low solvent concentration zones that pass through the conditioning zone of the pipeline reactor 10. For rapid mixing, which is preferred, CoV is to be achieved within ten diameters of the orifice 20 and preferably less than five diameters of the orifice 20.

Referring to FIG. 2, the discharged solvent diluted bitumen froth 36 is separated into solvent diluted tailings 38 and high diluted bitumen 40. Purge gas 42 may also be introduced into the vessel 28 to mitigate phase separation, for instance due to elevation of high point of the mixer 10 above the froth separation vessel 28. Vent gases 44 may also be removed.

In another optional aspect, the blending of the mixture is performed to achieve a desired density differential between the solvent diluted bitumen and the aqueous phase to enhance bitumen recovery in the froth separation vessel. As the density of bitumen is similar to that of water, undiluted bitumen in the feed will tend to stay with the aqueous phase rather than the high diluted bitumen phase which has a density differential with respect to the aqueous phase, resulting in reduced overall bitumen recovery. The amount of undiluted bitumen depends on the mixing and thus can be represented by the CoV. The CoV may therefore be managed and controlled to a sufficiently low level so as to reduce undiluted bitumen in the settler feed which, in turn, results in improved recovery of the bitumen in the high diluted bitumen stream. For instance, in a two-stage settler arrangement, the mixing for the feed provided to the first stage vessel may have a sufficiently low first stage $CoV_1$ to achieve bitumen recovery ranging from about 90% to about 97%, preferably about 95%, and the mixing for the feed provided to the second stage vessel may have a sufficiently low second stage $CoV_2$ to achieve an overall bitumen recovery ranging above 98%. In another aspect, the CoV is sufficiently low, for instance around 1% or lower, to use a single settler vessel to effect the separation with adequate recovery.

In another optional aspect, the solvent and the bitumen froth are sufficiently blended based on their initial temperatures so that the solvent diluted bitumen mixture introduced into the separation vessel is discharged at a generally consistent temperature within the stream to avoid temperature variations within a same portion of discharged solvent diluted bitumen. The bitumen froth or underflow stream temperature may differ from the solvent temperature and thus, without sufficient blending to a consistent mixture temperature, there can be thermal gradients in the discharged solvent diluted bitumen and in the froth separation vessel, which would adversely impact the separation performance. The settler vessels are large vessels whose performance can be susceptible to thermal upsets. Thus, controlling the mixing to provide consistent temperature of throughout the feed allows effective operational performance of the settler vessel.

Referring now to FIG. 3, illustrating an overall two-stage froth settling process, the bitumen froth 12 is supplied to a first pipeline reactor 10*a* where it is mixed with a recovered solvent stream 46 to form the conditioned PFT settler feed for the first stage vessel 28*a*. In another optional aspect, the recovered solvent 46 maybe supplemented by trim diluent/solvent 48 to permit adjusting the S/B ratio in the froth settler feed without modifying operating conditions on the second stage settling vessel, facilitating start up or shut down operations of the froth settling process, or a combination thereof. The conditioned PFT settler feed is introduced into the first stage froth settler vessel 28*a* via the discharge 36*a*, which is preferably configured as in FIG. 2.

Referring now to FIGS. 1, 4, 5 and 6, the solvent addition pipeline reactor has the discharge 36 for discharging conditioned PFT settler feed 34 into the froth settling vessel. The discharge 36 of the pipeline reactor is preferably provided at the end of a feedwell which provides axi-symmetrical distribution of PFT settler feed 34 into the settler vessel 28. The diluted froth discharged from the pipeline reactor as conditioned PFT settler feed 34 is suitable for gravity separation of diluted bitumen from water, minerals and precipitated asphaltenes in a froth settling vessel 28, for example as illustrated in FIG. 2.

Figure 6:
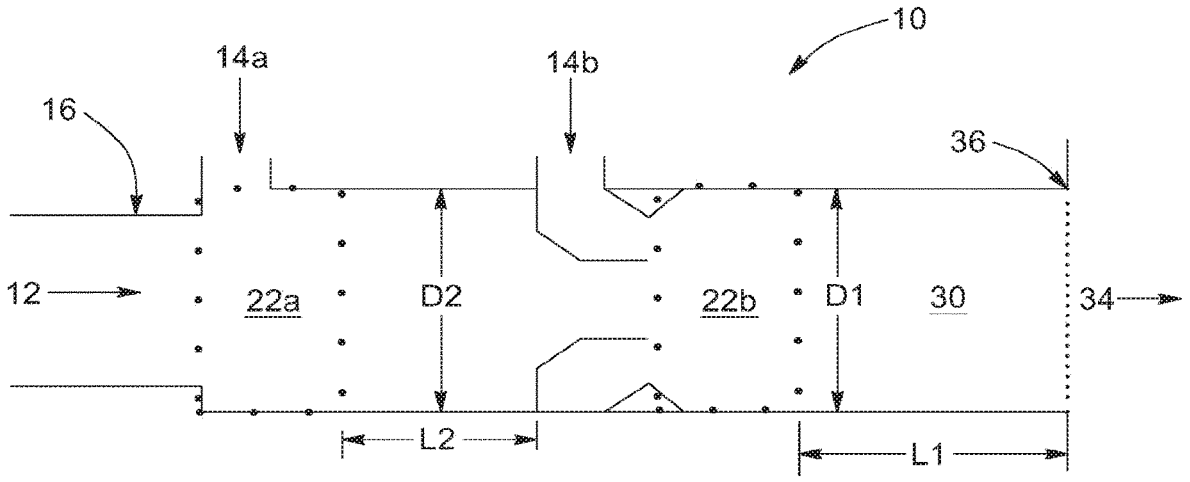
FIG. 6 is a plan cross-sectional view of a solvent addition pipeline reactor according to a further embodiment of the present invention.

Alternatively, as shown in FIG. 6, there may be several mixing zones. More particularly, the pipeline reactor 10 may include a pre-blending zone 22*a* where a first amount solvent 14*a* is mixed into the froth or underflow 12 and subsequently another mixing zone 22*b* where a second amount of solvent 14*b* is introduced into the oncoming solvent pre-diluted bitumen froth to produce the solvent diluted froth that then flows through the conditioning zone 30 and eventually to the discharge 40 as conditioned PFT settler feed 34. The premix zone 22*a* may use a standard pipe tee or "tee mixer" followed by a pipeline to blend the streams to an acceptable first $CoV_1$ unless layout considerations limit the length of the pipeline to less than 100 pipe diameters, in which case a static mixer (not illustrated) may assist in blending the streams. Preferably, this embodiment of FIG. 6 allows blending the first portion of the solvent 14*a* into the feed 12 at a level below that required to initiate asphaltene precipitation and the second portion of the solvent 14*b* is subsequently mixed into the pre-diluted mixture in an amount to effect asphaltene precipitation. This staging of solvent addition may improve the addition and blending of solvent into the feed. In another aspect, the staged mixing is performed to minimize hydraulic losses associated with the pipelining of bitumen froth. In addition, for underflow from a froth settler, there may also be a pump (not illustrated) in the pre-mix section 22 to assist dispersing aggregated bitumen-asphaltene globules prior to a second amount of solvent addition.

Figure 4:
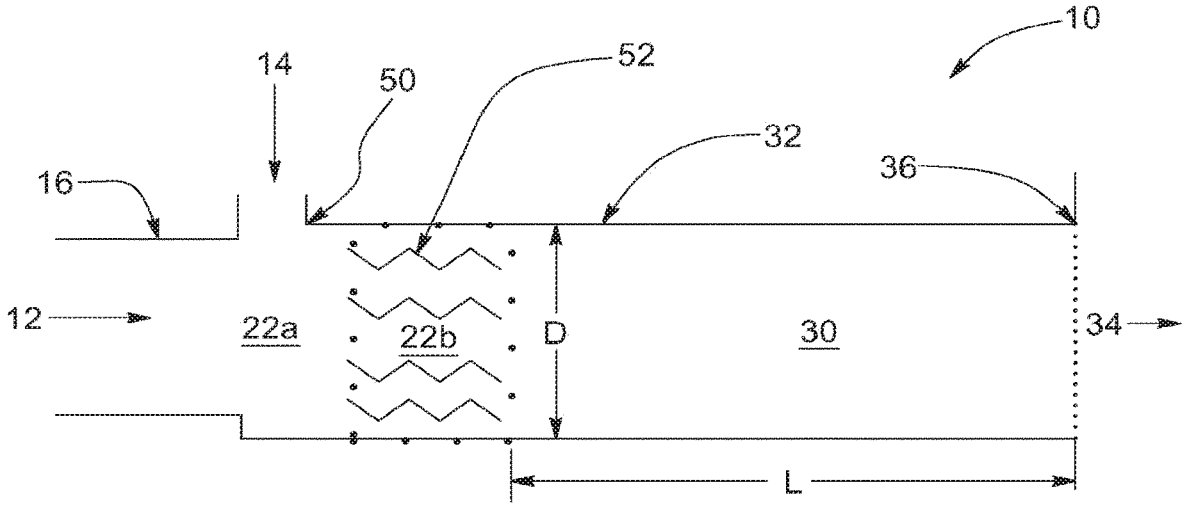
FIG. 4 is a plan cross-sectional view of a solvent addition pipeline reactor according to another embodiment of the present invention.

Furthermore, referring to FIG. 4, the pipeline reactor 10 may include a standard pipe tee or "tee mixer" 50 followed by a static mixer 52, in lieu of the co-annular type mixer illustrated in FIG. 1, for blending the bitumen froth 12 with the solvent 14. In such a case, it is preferable that the large viscosity difference between the input streams is taken into account for the static mixer. For detailed design of tee and static mixer configurations, one may look to "Handbook of Industrial Mixing: Science and Practice" E. Paul, V Atemio-Obeng, S Krestra. Wiley Interscience 2004. The rapid mixing and blending permits tubular plug flow for development of densified asphaltene floc settling structures and coalesced water within the length L of the conditioning section 30 of the PFT pipeline reactor 10. Static mixers may effectively mix and blend fluids with acceptable shear rates and can be assessed by CFD techniques. Depending on the length L and the pipe configuration upstream of the discharge into the settling vessel, the static mixer may be arranged at various locations. For instance, if L is particularly short, the static mixer may be arranged in the feedwell inside the vessel. Preferably, the static mixer is provided outside the vessel for ease of maintenance and monitoring.

Referring now to FIG. 1, the solvent diluted bitumen or underflow 12 passes from the mixing zone directly to the pipeline conditioning zone 30. More regarding the pipeline conditioning zone will be discussed below in connection with the operation of the present invention.

FIG. 2 shows a more detailed embodiment of the froth settler vessel 28 used in connection with the present invention. The conditioning section of the PFT pipeline reactor is also part of the feedwell pipe to froth settling vessel 28 discharging at an elevation to preferably provide axis-symmetrical flow into the froth settling vessel 28. In the froth setting vessel 28, the conditioned feed separates into the overflow product stream 40 or high diluted bitumen and an underflow stream 38. It is also noted that the vapor space of the froth settler vessel 28 is preferably supplied with the purge gas 42 to maintain a sufficient pressure in the froth settling vessel 28 that prevents phase separation within the PFT reactor 10. Phase separation in the PFT reactor may adversely affect the asphaltene floc structure.

FIG. 3 shows a more detailed embodiment of the two-stage PFT process used in connection with the present invention with PFT pipeline reactors 10*a* and 10*b* conditioning the feed to the $1^{st}$ and $2^{nd}$ stage forth settler vessels respectively. In addition, the trim diluent 48 may be added to the solvent to the 1st stage PFT reactor 10*a* to permit close control of the S/B ratio and facilitate start up or shut down operations.

Figure 5:
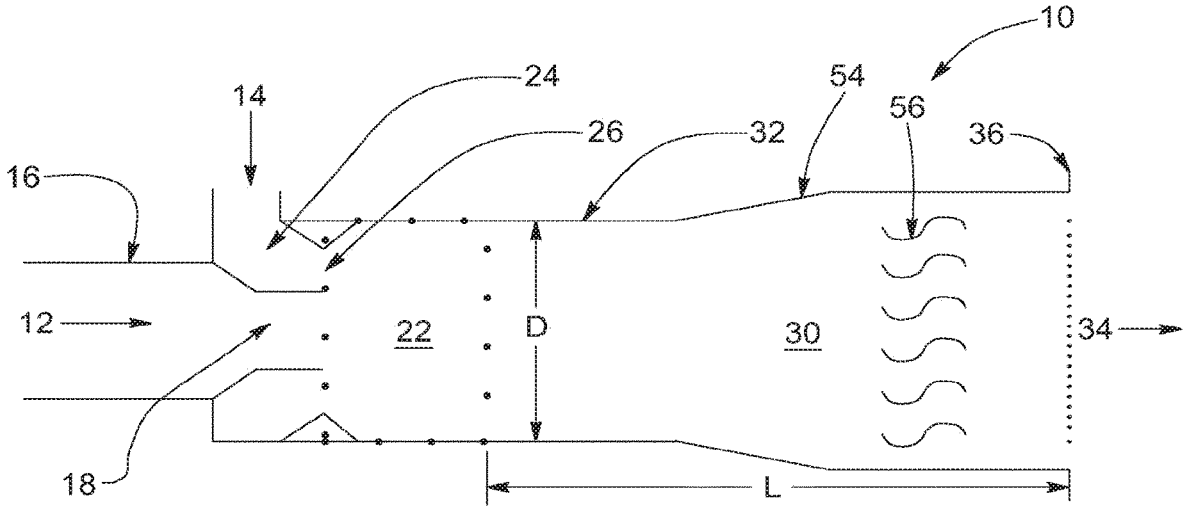
FIG. 5 is a plan cross-sectional view of a solvent addition pipeline reactor according to yet another embodiment of the present invention.

FIG. 5 shows further embodiments of the pipeline reactor and settler vessel combinations, with optional elements, used in connection with the present invention. For instance, as shown in FIG. 5, the conditioning section of the reactor downstream of the solvent injection and mixing zones may include an expansion reducer 54 and/or flow diffuser 56. More regarding the flow diffuser will be discussed in greater detail herein-below.

In one embodiment of the present invention, the Camp number may be used to determine preferred operating conditions and equipment configurations for mixing. The Cumulative Camp number is a dimensionless term developed in water treatment flocculation systems as a measure of the extent of coagulation of aggregates and combines shear rates with duration. Camp numbers are associated with increasing aggregate coagulation provided that shear rates are below a critical value that causes the aggregates to break up. Duration reflects the time exposure of the fluid to shear to produce optimum flocculated aggregates for separation.

Pilot test scale of PFT reactors coupled to a froth settling vessel demonstrated acceptable separation of high diluted bitumen from diluted froth with cumulative Camp numbers between 5,000 and 12,000. Shear and pipe fittings such as elbows, bypass tees and isolation valves contribute to cumulative Camp number. As the shear in piping is directly related to the velocity in the pipe, an expansion reducer 54 as illustrated in FIG. 5 provides an option to manage the cumulative Camp number provided the layout incorporates provisions to mitigate settling of minerals and excessive coalescence of free water.

In one aspect, the PFT pipeline reactor discharges via a discharge nozzle 36 directly into the settler vessel 28 with sufficient axi-symmetric phase and velocity distribution to promote integrity and settling of the precipitated aggregates and water drops with suspended minerals. In an optional aspect, flow diffusers 56 are provided and configured to redistribute coalesced water and poor flow velocity patterns from upstream pipe fittings, such as elbows, to promote consistent axi-symmetric flow and velocity into the settling vessel. Other flow conditioning arrangements and configurations may also be used to achieve axi-symmetry of the settler feed flow.

In this regard, when the solvent containing stream is added to the bitumen froth or underflow stream, the two streams initially mix together as substantially miscible components. After the solvent dilutes the bitumen components, and in the case of paraffinic solvent reacts to form asphaltene flocs and water drops, the solvent diluted mixture forms stream containing immiscible components. The immiscible components may tend to separate in-line, particularly when the pipeline leading to the settler vessel has elbows and curvatures and the like which may accelerate one component relative to another, intensifying in-line separation and increasing the relative velocity differential between some of the immiscible components. For example, in some cases, an aqueous component may separate and form a slip stream along one side of the pipe conduit while the hydrocarbon component occupies the other side and the aqueous and hydrocarbon components move at different velocities. In other cases, due to pipeline configuration, a component may be induced to have a spiral-like trajectory along the pipeline resulting in inconsistent discharge into the settler vessel. If the feed into the settling vessel has irregular velocity distributions of immiscible components such as the hydrocarbon and aqueous components, the separation performance can be significantly decreased.

In order to mitigate the separation of the immiscible components of the solvent diluted bitumen froth or underflow prior to introduction into the settling vessel, the feed line to the vessel may be configured or provided with means in order to redistribute the velocity and composition gradients that may have developed from various upstream pipeline geometries and fittings.

Figure 8:
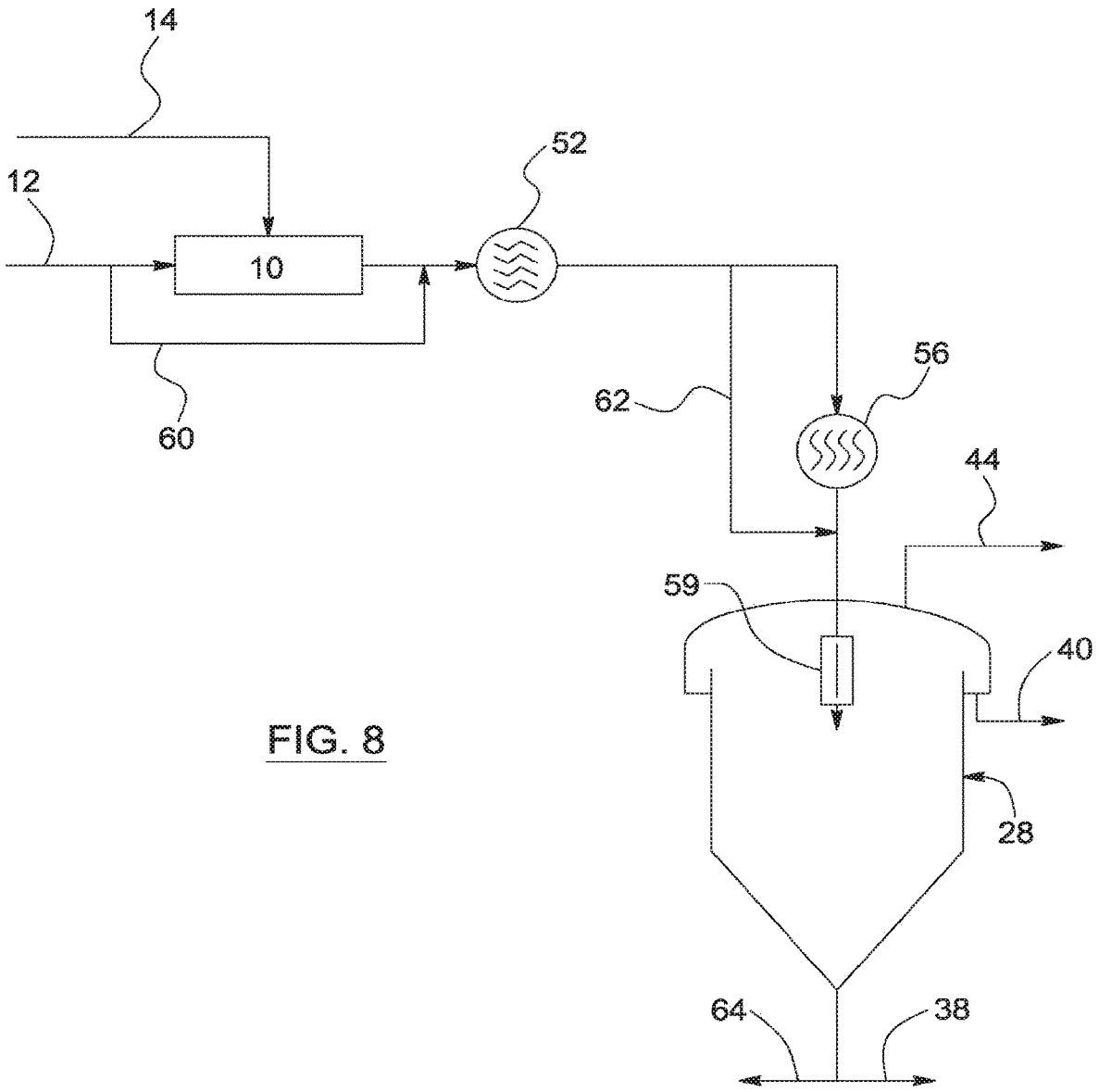
FIG. 8 is a plan cross-sectional view of a PFT system including a froth settling vessel (FSV) according to a further embodiment of the present invention.

Referring to FIGS. 5 and 8, a flow diffuser 56 is provided prior to introducing the solvent diluted bitumen froth into the settler vessel. In certain plant setups, it is necessary to have pipelines with arrangements that are non-linear and sometimes winding from the solvent addition point and the settler vessel discharge. By employing a flow diffuser, the negative effects of upstream pipeline bends and elbows can be mitigated. Preferably, the flow diffuser is provided proximate to the settler. Also preferably, the pipeline downstream from the flow diffuser that feeds the settler is substantially linear and avoids curvatures, elbows or fitting that would induce phase separation or phase velocity differentials.

In another optional aspect, the feed line may be configured so as to avoid significant separation inducing arrangements, such as elbows or significant curvatures, between the solvent addition point and the settler discharge point. It should also be noted that the feed line may be configured so as to avoid significant separation inducing arrangements, such as elbows or significant curvatures, between the point at which the immiscible components form (which would be a distance downstream from the solvent addition point) and the settler discharge point.

Referring to FIG. 8, in another optional aspect, a straightener 59 may be provided downstream of the diffuser 56 for straighten stray flow currents. The diffuser redistributes the velocities of the components of the in-line flow, but the resulting diffused flow may still have circular or rotational flow patterns which, if allowed to persist until the discharge, can negatively impact the separation performance and reliability. The straightener 59 may comprise at least one plate spanning the diameter of the pipe and extending a certain length along the pipe. The straightener 59 may be located proximate the discharge of the feedwell and may be located inside or outside of the separation vessel 28. Preferably, the straightener 59 comprises at least two crossed plates forming at least four quadrants for straightening the fluid flow prior to discharge. It should be understood that there may be additional plates or structures for effecting the straightening. The straightener 59 may be sized to have a length sufficient to allow straightening while minimizing fouling. Thus, the diffuser restricts larger bulk movements such as slip streams while the straightener removes residual circular or eddy-like flow patterns.

In another optional aspect, various sections of the pipeline extending from the solvent addition device 10 to the discharge nozzle 36 may be sized to achieve preferred conditioning of the solvent diluted material and its various components including hydrocarbon, aqueous and gas phases.

According to an embodiment of the invention, the pipeline reactor combines knowledge of the difference between mixing of miscible components and their mass transfer limitations as well as mixing of non-miscible components with rapid stream mixing and coalescence/flocculation of diluted froth streams to produce an improved diluted froth or underflow tailings stream for separating a high diluted bitumen stream from a bottoms stream comprising minerals, water and asphaltenes. Implementation of the pipeline reactor in paraffinic froth treatment provides advantages related to improved product quality and bitumen recovery.

According to some embodiments of the solvent pipeline reactor, the specification of the orifice and associated solvent injection limit contact of the froth or underflow with the interior pipe wall to avoid non-symmetrical flow patterns that inhibit rapid mixing. If the high viscosity media, i.e. the froth or underflow, contacts the walls it tends to mix slowly with the lower viscosity solvent due to the presence of the wall preventing low viscosity media from blending from all sides. Mixing time would thus be increased as blending is impeded on the side on which the high viscosity fluid is against the interior pipe wall.

The blending specification to CoV also promotes recovery of bitumen to the froth settler product. If bitumen is not diluted when mixed with solvent, the high density of bitumen inhibits the separation from aqueous systems in the froth settler vessel.

The specification on CoV also blends froth or underflow stream temperature with the solvent temperature to a consistent temperature of the blended streams feeding the froth settling vessel to promote thermal stable conditions in the froth separation vessel.

According to an embodiment of the invention, the system uses knowledge of the cumulative Camp Number to design a PFT reactor system to improve the coalescence/flocculation of contaminants in the feed supplied to a paraffinic froth treatment settler. This knowledge overcomes various drawbacks and inefficiencies of known techniques, in part by accounting for conditioning times for the reactions both in terms of shear magnitude, shear time, time and flow regime upon introduction into the froth settler vessel. For instance, exceeding the cumulative Camp number increases the problem and frequency of breakdown of the coalesced water droplets and aggregated asphaltenes, leading to reduced separation performance in terms of recovery or product quality or both.

In addition, the distribution pattern from the pipeline reactor into the settler preferably provides a substantially axi-symmetrical flow feeding and loading in the settler. Non-axi-symmetrical loading causes upsets and unpredictable settler performance. More regarding the operation of the PFT pipeline reaction and other embodiments of the present invention will now be discussed.

Froth or underflow is preferably be supplied from a dedicated pumped supply to maintain the hydraulic pressure at the PFT pipeline reactor inlet such that no additional pumping which may overshear PFT flocculated asphaltenes or coalesced water required to overcome both static and differential pipe head losses prior to the froth settling vessel.

The froth or underflow supplied to the pipeline reactor is envisioned as being instrumented (not shown) with a continuous flow meter, a continuous density meter, and/or analyzer and means to control the froth or underflow flow by any standard instrumentation method. An algorithm from the density meter or analyzer would input to the flow meter to determine the mass flow of froth or underflow to the given PFT pipeline reactor.

The solvent solution supplied to the reactor is preferably a pumped liquid and instrumented (not shown) with a continuous flow meter, a continuous density meter, and or analyzer. The delivery pressure of the solvent solution at the pipeline reactor would preferably reflect the hydraulic properties of the solvent and the nozzle or aperture configuration to achieve the initial mixing.

The froth separation vessel pressure is preferably tied to the pipeline reactor pressure to ensure that no low pressure points at undesirable places exist in the feed system that would compromise floc formation. One example of an outcome would be that pressure is maintained to prevent cavitations which may cause pressure fluctuations at elevated points in the reactor system due to differences in density and differences in friction loss between bulk fluids and their individual components. The design and operation thus preferably accounts for these factors to produce an optimum overall design to ensure the feed is conditioned appropriately and that the separation can occur in an optimum manner.

The injected solvent solution is preferably ratio controlled to the quantity of feed froth for first stage settler and underflow for second stage settlers. Trim solvent may be added to the first stage settler solvent-containing stream in upset or startup modes. In normal operation, the solvent added upstream of the first stage settler consists of the overflow stream from the second stage settler. Downstream from the mixing zone, an in-line meter or a small slip stream of diluted froth is continuously analyzed for solvent/bitumen ratio, which may then provide feedback to control the solvent dilution for a specific settler performance. The analytical methods to continuously monitor the solvent/bitumen ratio may be refractive index metering instrumentation such as disclosed in Canadian patent No. 2,075,108 with alternate methods such as deriving the solvent/bitumen ratio from blended hydrocarbon density temperature corrected to reference densities for bitumen and solvent and/or comparing the feed solvent/bitumen ratio to the overflow product solvent/bitumen ratio.

Rapid mixing of solvent solution into froth is preferred for flocculating reactions. Some theories have these reactions occurring at a molecular scale and occur in distinct stages. Firstly, the solvent as mixed into the froth reduces the viscosity of the hydrocarbon phase that allows free water and mineral to start coalescing. The solvent causes the asphaltenes to precipitate together with dispersed water and minerals (bound to bitumen). Secondly, both the water coalesces and the asphaltenes flocculate to larger particles in the initial conditioning stage, where rearrangement reactions increase the strength of the flocculated asphaltenes. Thirdly, if excess energy is input by too long a pipe, high velocities or over aggressive mixing apparatuses, over-shearing disperses the flocculated asphaltenes and coalesced water structures.

Rapid mixing thus quickly establishes the starting point for the flocculation and coalescing reactions to occur. The pipeline provides the conditioning time for the reactions to maximize the separation of the high diluted bitumen from the feed stream. The instrumentation identified in the operation description permits process control to deliver conditioned feed. The critical Camp number where shear adversely affects flocculation may be determined or estimated to establish preferred design parameters of the system.

Referring to FIG. 8, the pipeline reactor 10 may also have a bypass line 60 for bypassing the reactor 10 in order to repair, replace or conduct maintenance or cleaning on the pipeline reactor 10. The diffuser 56 may also have a bypass line 62 for similar reasons. In addition, the separation vessel 28 may have a recirculation line 64 for recycling a portion of the discharged underflow back into the feed of the separation vessel 28, either upstream or downstream of the reactor 10, mixer 52 and/or diffuser 56, and/or directly back into the vessel 28, depending on the given scenario. Recirculation may be desirable during startup, downtimes, upset or maintenance operation modes, for example. Recirculation of a portion of the underflow may also have various other advantageous effects.

It should be noted that embodiments of the present invention described herein may be used in other applications in the field of oil sands fluids mixing and processing, for instance for inducing precipitation, chemical reaction, flocculation, coagulation, pre-treatments for gravity settling, and the like, by injecting in-line injection of one fluid into another. In one example, polymer flocculent can be injected into mature fine tailings to induce flocculation prior to depositing the flocculated material to allow dewatering and drying. In another example, a demulsifying or conditioning agent can be injected into froth or high viscosity underflow streams such as from froth settling vessels, thickeners to promote flocculation and or coalesce separations in subsequent separation vessels.

Recognizing initial simple blending model used in naphthenic froth treatment was incomplete or inapplicable in paraffinic froth treatment as asphaltene aggregation is a flocculation process, led to the development of paraffinic embodiments of the present invention. By way of examples, it is noted that various hydraulic investigations of feed piping systems for pilot and commercial paraffinic froth treatment process were conducted and identified that various fittings commonly encountered in piping networks such as valves, tees and elbows create high turbulence levels translating to high shear zones and non axi-symmetric flow regimes. These investigations revealed several advantageous aspects of embodiments of the present invention.

It should also be noted that embodiments of the co-annular pipeline reactor and other mixing and conditioning configurations described herein may have a number of other optional or preferred features, some of which are described in Canadian patent application Nos. 2,701,317 and 2,705,055, which are incorporated herein by reference.

Finally, it should be understood that the present invention is not limited to the particular embodiments and aspects described and illustrated herein.

The invention claimed is:

1. A solvent treatment process for treating a high viscosity bitumen-containing stream, comprising:

contacting the high viscosity bitumen-containing stream with a solvent-containing stream having a lower viscosity in a pipeline section comprising interior pipe walls, such that the solvent-containing stream flows downstream along the interior pipe walls prior to mixing between the high viscosity bitumen-containing stream with the solvent-containing stream;

mixing the high viscosity bitumen-containing stream with the solvent-containing stream sufficiently downstream of the pipeline section to produce a mixed in-line flow of a solvent diluted material;

supplying the solvent diluted material into a separation vessel; and withdrawing from the separation vessel a high diluted bitumen component and a solvent diluted tailings component.

2. The process of claim 1, wherein the bitumen-containing stream is provided at a flow rate between about 0.5 m/s and about 1.5 m/s and the solvent-containing stream is provided at a flow rate between about 2.0 m/s and about 4.0 m/s.

3. The process of claim 1, wherein the in-line flow of the solvent diluted material is provided at a flow rate sufficient to avoid minerals from settling prior to introduction into the separation vessel.

4. The process of claim 1, comprising providing a static mixer downstream of the pipeline section to perform the mixing.

5. The process of claim 1, wherein the pipeline reactor is a first pipeline reactor and the contacting of the bitumen-containing stream with the solvent-containing stream comprises:

adding a first amount of the solvent-containing stream to the bitumen-containing stream in the first pipeline reactor to produce an intermediate mixture; and adding a second amount of the solvent-containing stream to the intermediate mixture in a second pipeline reactor, wherein the second amount is sufficient to produce the in-line flow of solvent diluted material.

6. The process of claim 5, comprising pumping the intermediate mixture prior to adding the second amount of the solvent-containing stream.

7. The process of claim 1, wherein the solvent-containing stream comprises paraffinic solvent and the bitumen-containing stream is a bitumen froth stream.

8. The process of claim 1, wherein the separation vessel is a first stage gravity settler vessel, the bitumen-containing stream is a bitumen froth stream and the solvent-containing stream is a first stage solvent-containing stream, the process further comprising:

subjecting the high diluted bitumen component to solvent separation to produce a recovered solvent component;

contacting the solvent diluted tailings withdrawn from the first stage gravity settler vessel with a second stage solvent stream containing the recovered solvent to form a second stage solvent diluted material;

supplying the second stage solvent diluted material to a second stage gravity settler vessel;

withdrawing from the second stage gravity settler vessel a second stage solvent diluted tailings component and a second stage solvent diluted bitumen component;

recycling the second stage solvent diluted bitumen component as at least part of the first stage solvent-containing stream;

subjecting the second stage solvent diluted tailings component to solvent recovery to produce a second stage recovered solvent component; and providing the second stage recovered solvent component as part of the second stage solvent stream.

9. A solvent treatment process for treating a bitumen-containing stream, comprising:

contacting the bitumen-containing stream with a solvent-containing stream to produce an in-line flow of solvent diluted material comprising immiscible aqueous and hydrocarbon components;

transporting the in-line flow of solvent diluted material toward a separation vessel using a pipeline comprising at least one fitting causing at least some of the immiscible aqueous and hydrocarbon components of the solvent diluted material to separate in-line and have a velocity gradient therebetween;

diffusing the solvent diluted material to redistribute the velocity gradient created by the at least one fitting, prior to introduction into the separation vessel, to produce a diffused solvent diluted material stream flowing in-line, the diffused solvent diluted material stream having a reduced velocity gradient between the immiscible aqueous and hydrocarbon components compared to the velocity gradient prior to diffusing;

introducing the diffused solvent diluted material stream into the separation vessel; and withdrawing from the separation vessel a high diluted bitumen component and a solvent diluted tailings component.

10. The process of claim 9, wherein at least one fitting comprises an elbow.

11. The process of claim 9, wherein the transporting of the solvent diluted material induces pre-mature separation or acceleration of the immiscible aqueous and hydrocarbon components with respect to each other.

12. The process of claim 9, wherein the diffusing is performed outside of the separation vessel.

13. The process of claim 12, comprising flowing the diffused solvent diluted material stream in a substantially linear manner into the separation vessel.

14. The process of claim 13, wherein the flowing of the diffused solvent diluted material stream is performed in a substantially vertically downward manner.

15. The process of claim 14, comprising feeding the diffused solvent diluted material stream to the separation vessel while avoiding contact with fittings.

16. The process of claim 9, wherein the bitumen-containing stream is a bitumen froth stream.

17. A paraffinic treatment process for treating a bitumen-containing stream, comprising:

an in-line mixing stage to produce an in-line flow of paraffin diluted material containing precipitated aggregates comprising asphaltenes, fine solids and water, the in-line mixing stage comprising:

mixing the bitumen-containing stream with a paraffinic solvent-containing stream to produce the in-line flow of paraffin diluted material;

an in-line conditioning stage comprising imparting sufficient energy to the in-line flow to allow build-up and densification of the precipitated aggregates while avoiding overshear breakup thereof;

a discharge stage comprising discharging the in-line flow into a separation vessel to allow separation of the precipitated aggregates in a solvent diluted tailings component from a high diluted bitumen component; and pressurizing the separation vessel at a separation vessel pressure, wherein low pressure points and cavitations are avoided from the in-line mixing stage to the discharge stage by tying the separation vessel pressure and a pressure of the in-line flow downstream of the in-line mixing stage to each other.

18. The process of claim 17, wherein the bitumen-containing stream comprises a bitumen froth stream or an underflow stream from a bitumen froth separation vessel.

19. The process of claim 18, wherein the in-line mixing stage comprises:

introducing the solvent-containing stream into the bitumen-containing stream via a tee junction to form a mixture; and then passing the mixture through an in-line static mixer.

20. The process of claim 17, wherein the in-line mixing stage comprises:

adding a first amount of the solvent-containing stream to the bitumen-containing stream to produce an intermediate mixture; and adding a second amount of the solvent-containing stream to the intermediate mixture sufficient to produce the in-line flow of solvent diluted material.

21. The process of claim 20, comprising pumping the intermediate mixture prior to adding the second amount of the solvent-containing stream.

22. The process of claim 17, wherein the separation vessel is a first stage gravity settler vessel, the bitumen-containing stream is a bitumen froth stream and the solvent-containing stream is a first stage solvent-containing stream, the process further comprising:

subjecting the high diluted bitumen component to solvent separation to produce a recovered solvent component;

contacting the solvent diluted tailings withdrawn from the first stage gravity settler vessel with a second stage solvent stream containing the recovered solvent to form a second stage solvent diluted material;

supplying the second stage solvent diluted material to a second stage gravity settler vessel;

withdrawing from the second stage gravity settler vessel a second stage solvent diluted tailings component and a second stage solvent diluted bitumen component;

recycling the second stage solvent diluted bitumen component as at least part of the first stage solvent-containing stream;

subjecting the second stage solvent diluted tailings component to solvent recovery to produce a second stage recovered solvent component; and providing the second stage recovered solvent component as part of the second stage solvent stream.

23. The process of claim 9, wherein the fitting comprises a pipe curvature.

24. The process of claim 9, wherein the diffused solvent diluted material stream is discharged into the separation vessel via a discharge nozzle that is formed as a single aperture at an end of a feedwell located in the separation vessel.

25. The process of claim 24, wherein the feedwell is vertically oriented such that the diffused solvent diluted material stream is discharged vertically downward into the separation vessel via the discharge nozzle.

26. The process of claim 17, wherein the discharge stage comprises discharging the in-line flow from a discharge nozzle that is formed as a single aperture at an end of a feedwell located in the separation vessel, the feedwell being vertically oriented within the separation vessel and the discharge nozzle being located within a chamber of the separation vessel.

* * * * *